US012741788B2

(12) United States Patent
Abdiye et al.

(10) Patent No.: US 12,741,788 B2
(45) Date of Patent: Sep. 22, 2026

(54) LID FOR BEVERAGE CONTAINERS

(71) Applicant: 1329421 B.C. LTD., Vancouver (CA)

(72) Inventors: Abbey Abdiye, Burnaby (CA); Herb Bentz, Vancouver (CA)

( * ) Notice: Subject to any disclaimer, the term of this patent is extended or adjusted under 35 U.S.C. 154(b) by 57 days.

(21) Appl. No.: 18/753,907

(22) Filed: Jun. 25, 2024

(65) Prior Publication Data

US 2025/0388368 A1 Dec. 25, 2025

Related U.S. Application Data

(60) Division of application No. 17/230,851, filed on Apr. 14, 2021, now abandoned, which is a continuation of (Continued)

(51) Int. Cl.
*A47G 19/22* (2006.01)
*B65D 43/02* (2006.01)

(Continued)

(52) U.S. Cl.
CPC ..... *B65D 43/0212* (2013.01); *B65D 47/246* (2013.01); *B65D 51/10* (2013.01);

(Continued)

(58) Field of Classification Search
CPC A47G 19/2211; A47G 19/22; A47G 19/2272; B65D 43/0212; B65D 47/24;

(Continued)

(56) References Cited

U.S. PATENT DOCUMENTS 178,693 A * 6/1876 White ..... B65D 39/08 215/357
1,227,331 A * 5/1917 Slade ..... A47G 19/24 222/196.3

(Continued)

FOREIGN PATENT DOCUMENTS

KR 200489970 Y1 * 9/2019 ..... B65D 43/0214

*Primary Examiner* — Gideon R Weinerth

(57) ABSTRACT

A lid for a beverage container comprising a lower lid having a perimeter skirt adapted to secure the lower lid to an opening of the beverage container, a lip portion radially inward from the skirt and extending upward from the skirt and defining an inside surface, an annular portion radially inward from the lip portion and defining a plurality of openings through which liquid from the container may flow; an upper planar lid resting on the lower lid by gravity and having a perimeter edge that is sized to closely conform with the inside surface, the upper lid covering the annular portion as it rests on the lower lid, and a stop mechanism cooperating with the lower lid and the upper lid to limit the range of motion of the upper lid with respect to the lower lid, wherein the stop mechanism enables the upper lid to move away for a distance from the lower lid in response to pressure exerted upon the upper lid by liquid flowing out of the container through the openings as the container is tilted, and wherein the stop mechanism prevents the upper lid from being expelled from the lower lid, and wherein the upper lid returns to resting on the lower lid by gravity as the container is returned to vertical.

3 Claims, 20 Drawing Sheets

Related U.S. Application Data application No. 15/775,787, filed as application No. PCT/CA2016/051341 on Nov. 16, 2016, now Pat. No. 11,001,419.

(60) Provisional application No. 62/311,401, filed on Mar. 21, 2016, provisional application No. 62/256,110, filed on Nov. 16, 2015.

(51) Int. Cl.
*B65D 47/14* (2006.01)
*B65D 47/24* (2006.01)
*B65D 51/10* (2006.01)
*B65D 51/24* (2006.01)

(52) U.S. Cl.
CPC .. *B65D 51/245* (2013.01); *B65D 2543/00027* (2013.01); *B65D 2543/00046* (2013.01); *B65D 2543/00092* (2013.01); *B65D 2543/00296* (2013.01); *B65D 2543/00527* (2013.01); *B65D 2543/00537* (2013.01); *B65D 2543/00731* (2013.01); *B65D 2543/00796* (2013.01)

(58) Field of Classification Search
CPC ..... B65D 47/242; B65D 51/10; B65D 2543/00046; B65D 2543/00027; B65D 2543/00092; B65D 2543/00296; B65D 2543/00527; B65D 2543/000537; B65D 2543/000731; B65D 2543/00796
USPC ..... 220/703
See application file for complete search history.

(56) References Cited

U.S. PATENT DOCUMENTS 1,637,562 A * 8/1927 Frye ..... B65D 51/10 215/235
2,017,036 A * 10/1935 Brady ..... B65D 47/14 215/307
2,358,600 A * 9/1944 Selten ..... A47G 19/2272 220/719
2,529,114 A * 11/1950 Tellier ..... A47G 19/2272 138/40
2,623,368 A * 12/1952 Olsen ..... A47G 19/2272 215/11.1
2,761,301 A * 9/1956 Tellier ..... A47G 19/2211 220/719
RE26,320 E * 12/1967 Miller ..... B65D 43/0212 220/374
3,459,324 A * 8/1969 Miller ..... B65D 51/1611 206/217
3,730,399 A * 5/1973 Dibrell ..... B65D 47/2018 222/518
5,477,979 A * 12/1995 Goessling ..... A47G 19/2272 220/259.3
5,540,350 A * 7/1996 Lansky ..... A47G 19/2211 220/713
6,199,711 B1 * 3/2001 Lansky ..... A47G 19/2211 220/255
8,424,711 B2 * 4/2013 Charbonnet ..... B65D 43/0208 220/717
2005/0224495 A1 * 10/2005 Kartinian ..... B65D 47/265 220/253
2005/0224505 A1 * 10/2005 Brown ..... B65D 43/0208 220/792
2013/0221002 A1 * 8/2013 Chen ..... B65D 43/0212 220/200
2014/0291338 A1 * 10/2014 Feldmann ..... A47G 19/2272 220/713
2017/0013985 A1 * 1/2017 Fan ..... A47G 19/2272
2017/0275062 A1 * 9/2017 Cudworth ..... F16K 15/144
2018/0194524 A1 * 7/2018 Chalermwinsuekun ..... A47G 19/2272
2018/0327149 A1 * 11/2018 Abdiye ..... B65D 47/246
2019/0159615 A1 * 5/2019 Maguire ..... B65D 47/2062
2021/0177173 A1 * 6/2021 Siegenthaler ..... A47G 19/2272
2022/0024655 A1 * 1/2022 Humphrey ..... B65D 41/0407
2022/0219872 A1 * 7/2022 Lin ..... B65D 51/2807
2023/0021579 A1 * 1/2023 Zabaleta ..... B65D 17/4014
2024/0172883 A1 * 5/2024 Lin ..... B65D 1/40
2025/0388368 A1 * 12/2025 Abdiye ..... B65D 43/0212
2025/0388374 A1 * 12/2025 Shklyar ..... B65D 47/40

* cited by examiner

FIG. 4
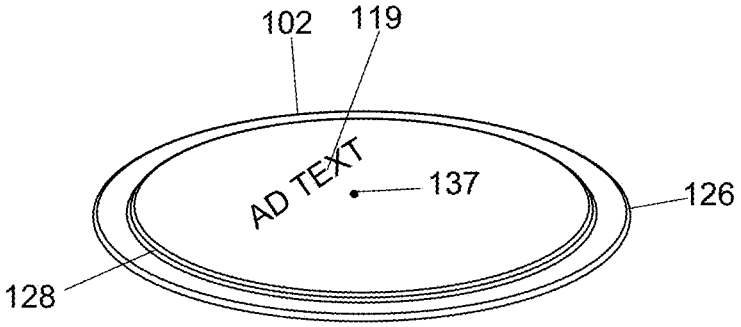
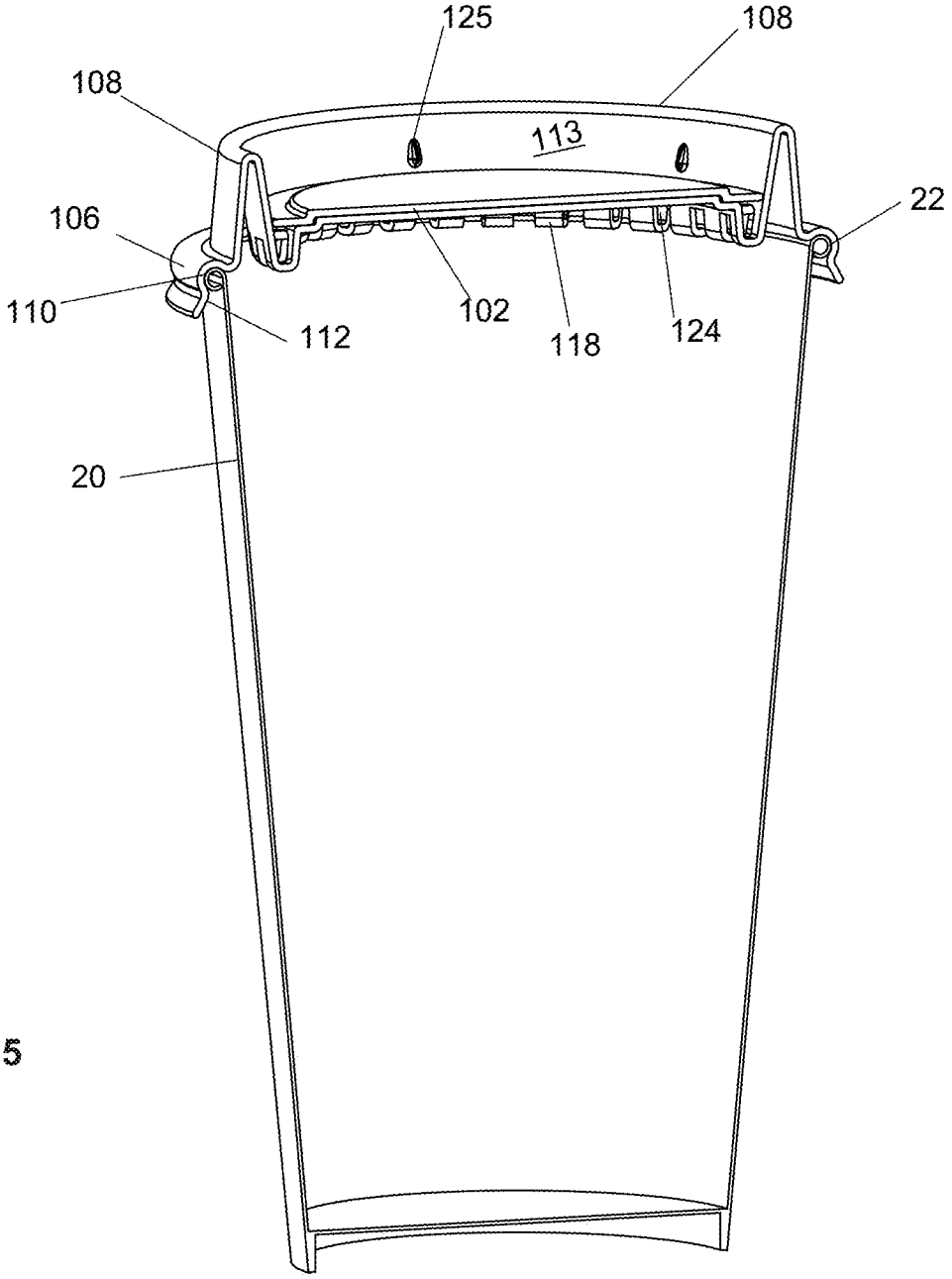
FIG. 5

FIG. 31
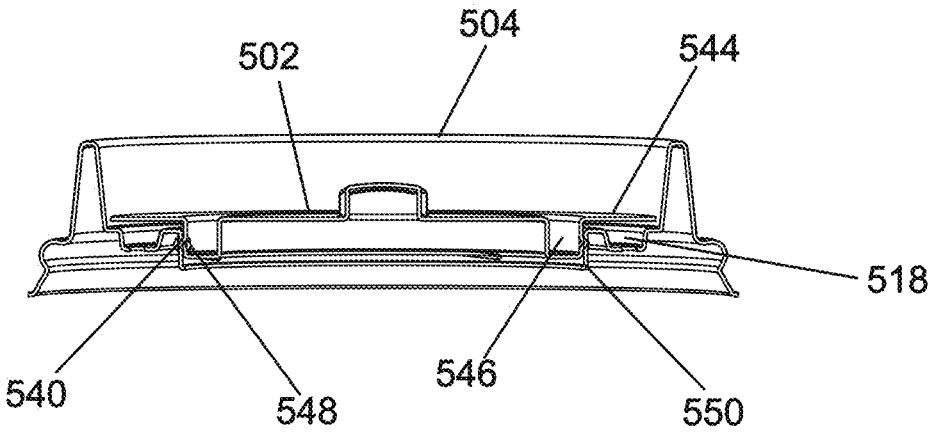
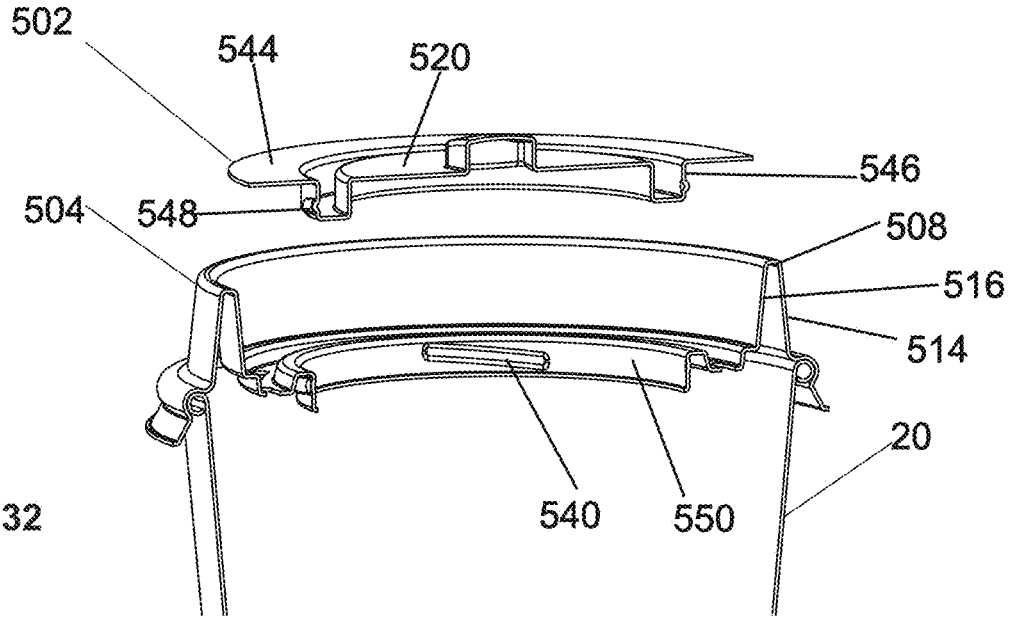
FIG. 32
FIG. 33
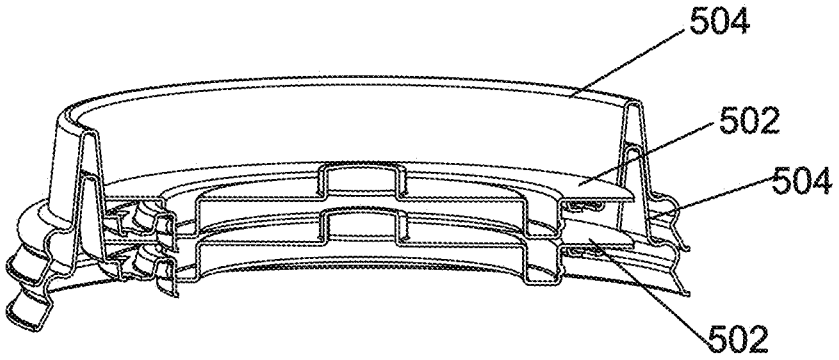

FIG. 42
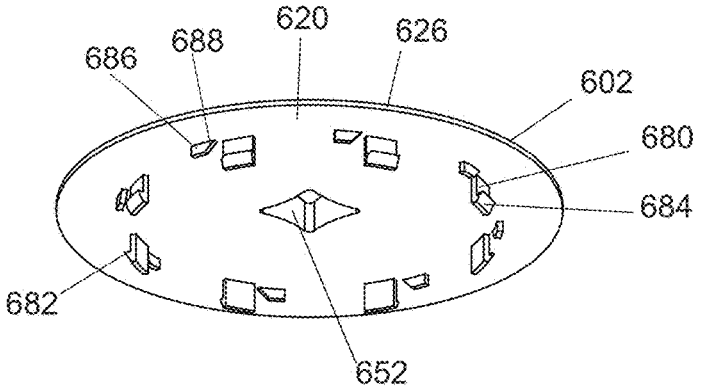
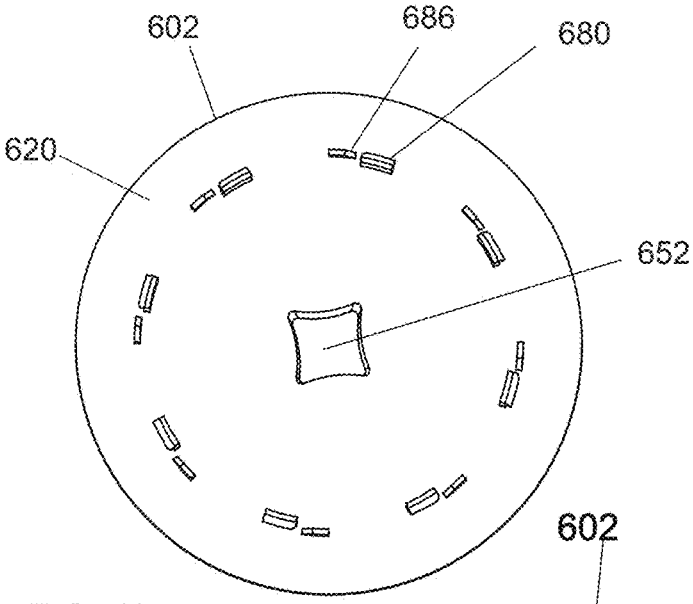
FIG. 43
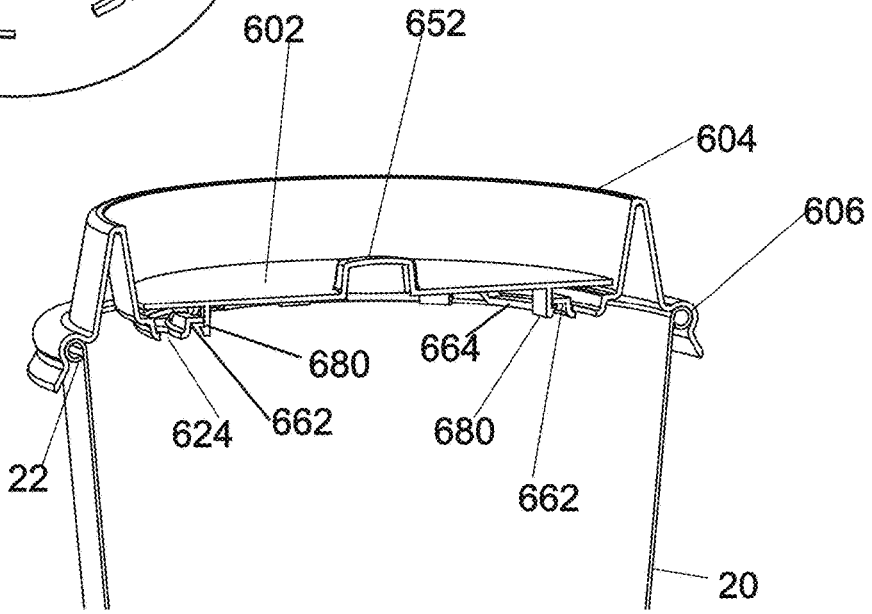
FIG. 44

LID FOR BEVERAGE CONTAINERS

BACKGROUND OF THE INVENTION

1. Field of the Invention

The present disclosure generally relates to lids for hot and cold beverage containers and cups.

2. Description of the Related Art

Lids of beverage cups, containers and the like are in wide use for various everyday applications, such as disposable soft drink cups and hot beverage cups used in the restaurant and take out beverage industries. While there are many configurations of lids in the prior art, many have drawbacks and there remains a need for an improved lid design.

SUMMARY OF THE INVENTION

In some aspects, the present invention provides a lid for a beverage container comprising: a lower lid having a perimeter skirt adapted to secure the lower lid to an opening of the beverage container, a lip portion radially inward from the skirt and extending upward from the skirt and defining an inside surface, an annular portion radially inward from the lip portion and defining a plurality of openings through which liquid from the container may flow; an upper planar lid resting on the lower lid by gravity and having a perimeter edge that is sized to closely conform with the inside surface, the upper lid covering the annular portion as it rests on the lower lid; and a stop mechanism cooperating with the lower lid and the upper lid to limit the range of motion of the upper lid with respect to the lower lid, wherein the stop mechanism enables the upper lid to move away for a distance from the lower lid in response to pressure exerted upon the upper lid by liquid flowing out of the container through the openings as the container is tilted, and wherein the stop mechanism prevents the upper lid from being expelled from the lower lid, and wherein the upper lid returns to resting on the lower lid by gravity as the container is returned to vertical.

In some embodiments, the lower lid may further include a horizontal central wall radially inward from the annular portion upon which the upper lid rests.

In some embodiments, the annular portion may comprise a trough in which the openings are defined.

In some embodiments, the stop mechanism may comprise one or more stop members protruding from the inside surface of the lip portion to interfere with the upper lid to limit the movement thereof, the one or more stop members being located above a plane of the central wall by a distance to enable sufficient upward movement of the upper lid to allow a flow of liquid out of the container between the inside surface and the perimeter edge of the upper lid.

In some embodiments, stop mechanism may comprise a plurality of stop members arranged along a horizontal second plane around the circumference of the inside surface and the second plane being distanced above a first plane of the central wall to enable sufficient upward movement of the upper lid to allow a flow of liquid out of the container between the inside surface and the upper lid.

In some embodiments, each stop member may comprise a protrusion having a tapered upper edge that merges gradually with the inside surface to ease assembly of the upper lid onto the lower lid, and an abrupt bottom edge that interferes with expulsion of the upper lid from the lower lid once the lid has been assembled.

In some embodiments, the central wall may define a hole, and the upper lid may include a downward extension received within the hole and having an enlarged terminal portion to limit withdrawal of the extension from the lower lid, wherein the extension is sized to permit a tilting movement of the upper lid relative to the lower lid in response to pressure of liquid flowing out of the container via the openings.

In some embodiments, the lid may further include a circumferential ridge on the extension located between the terminal portion and a base of the extension, wherein the lower lid adjacent the hole may be releasable captured between the circumferential ridge and the upper lid by downward force applied to the upper lid by a user sufficient to urge the circumferential ridge through the hole to secure the upper lid to the lower lid.

In some embodiments, the lid may further include a grip member on a top surface of the upper lid to facilitate withdrawal of the lower lid adjacent the hole from between the circumferential ridge and the upper lid to permit the tilting movement of the upper lid.

In some embodiments, the lid may further comprise a plurality of plug members extending downward from a bottom surface of the upper lid corresponding in number to the plurality of openings, the plurality of plug members being configured to interfere with the plurality of openings when said structures are aligned to limit the flow of liquid out of the plurality of openings.

In some embodiments, the lid may further comprise an annular first vertical wall on the lower lid radially inward from the annular portion and having one or more channels angled to extend from a bottom of the first vertical wall towards a top thereof, and an annular second vertical wall extending downward from a bottom surface of the upper lid and configured to be in close proximity to the first vertical wall when the upper lid rests on the lower lid, the second vertical wall having a projection corresponding to the one or more channels on the first vertical wall and configured to travel within said one or more channels in a manner that rotation of the upper lid in one direction relative to the lower lid results in the projection traveling upward in the one or more channels causing the upper lid to rise relative to the lower lid to uncover the openings to allow liquid flow out of the lid, and rotation of the upper lid in the opposite direction relative to the lower lid results in the projection traveling downward in the one or more channels causing the upper lid to move into contact with the lower lid to cover the openings and restrict liquid flow out of the lid.

In some embodiments, the lid may further comprise a horizontal central platform on the upper lid having a grip member extending from a top surface thereof to facilitate rotation of the upper lid relative to the lower lid and thereby open and close the lid.

In some embodiments, the lid may further comprise a second annular portion on the lower lid radially inward from the openings on which are defined horizontally oriented alternating high portions and low portions that are joined by sloped ramps on one side, and tabs on a bottom surface of the upper lid arranged in a circular configuration, spaced radially inward from the perimeter edge and configured such that the tabs ride on the low portions, the sloped ramps and the high portions as the upper lid is rotated relative to the lower lid in a manner that rotation of the upper lid in one direction relative to the lower lid causes the tabs to ride from the low portion, up the slope ramp and onto the high portion causing the upper lid to rise relative to the lower lid to uncover the openings to allow liquid flow out of the lid, and rotation of the upper lid in the opposite direction relative to the lower lid causes the tabs to ride from the high portion, down the slope ramp and onto the low portion causing the upper lid to move into contact with the lower lids to cover the openings and restrict liquid flow out of the lid.

In some embodiments, the lid may further comprise a channel defined in one or both the high portions and low portions and oriented along a circumference of the lower lid, and a guide extending from the bottom surface of the upper lid configured to travel within the channel.

In some embodiments, the tabs may each comprise a flat body portion terminating in a radially outward facing hook portion that defines an upward facing sliding surface configured to ride along an underside of the low portions, the sloped ramps, and the high portions, and the body portion of the tab is configured to travel along an inside perimeter of the second annular portion, wherein the tabs retain the upper lid on the lower lid, and raise and lower the upper lid as the upper lid is rotated.

In some embodiments, the hook portion may further define a tapered lower surface that facilitates assembly of the upper lid onto the lower lid as the tapered lower surface deflects the tab inward as it travels over the inside perimeter of the second annular portion, and once past the inside perimeter of the second annular portion the tab returns to a resting position in which the upward facing surface on the hook portion undercuts the second annular portion to retain the upper lid on the lower lid.

BRIEF DESCRIPTION OF DRAWINGS

For a better understanding of the present invention and to show more clearly how it may be carried into effect, reference is made by way of example to the accompanying drawings in which:

FIG. 4. is a perspective view of an upper lid of the embodiment shown in FIG. 1;

FIG. 5. is a cross section view of an upper lid seated on a lower lid of the embodiment shown in FIG. 1 in a closed configuration, mounted on the rim of a cup;

FIG. 31. a sectional view of the embodiment shown in FIG. 23 in an open configuration;

FIG. 32. is a sectional view of the embodiment shown in FIG. 23 with the upper lid shown exploded from the lower lid;

FIG. 33. is a cross section view of stacked lids of the embodiment shown in FIG. 23;

FIG. 42. is a perspective view from the bottom of an upper lid of the embodiment shown in FIG. 40;

FIG. 43. is a bottom view of an upper lid of the embodiment shown in FIG. 40;

FIG. 44. a sectional view of the embodiment shown in FIG. 40 in the open configuration;

DETAILED DESCRIPTION OF THE INVENTION

Figure 1:
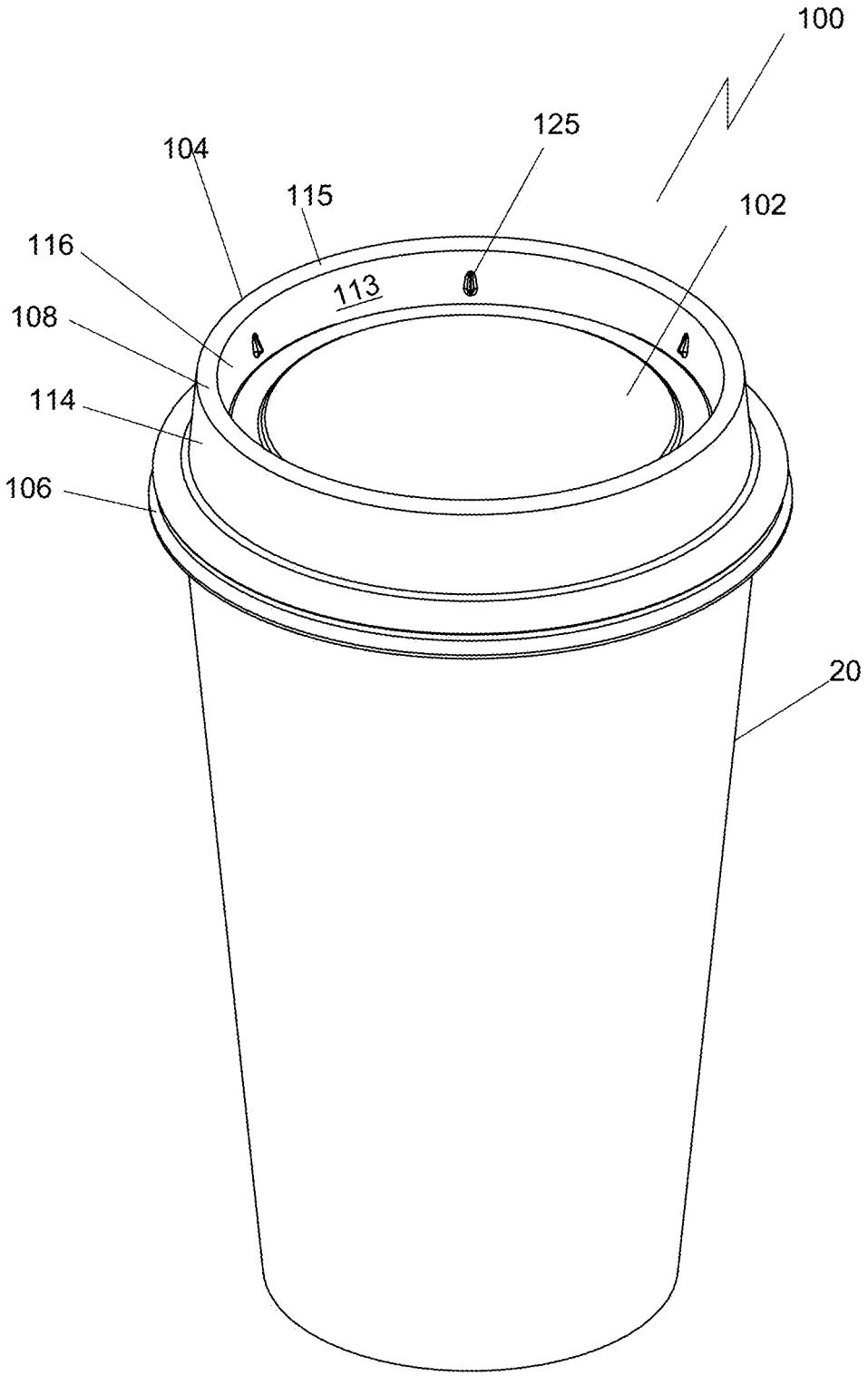
FIG. 1. is a perspective view of a lid for beverage cup in accordance with an embodiment of the present invention.
Figure 2:
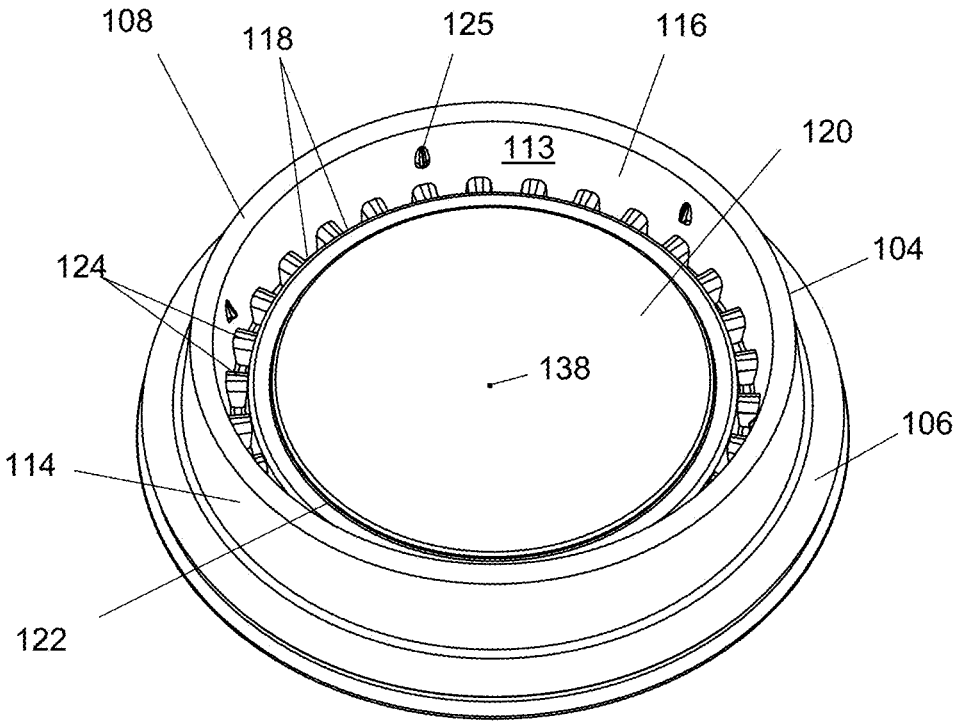
FIG. 2. is a perspective view of a lower lid of the embodiment shown in FIG. 1.
Figure 3:
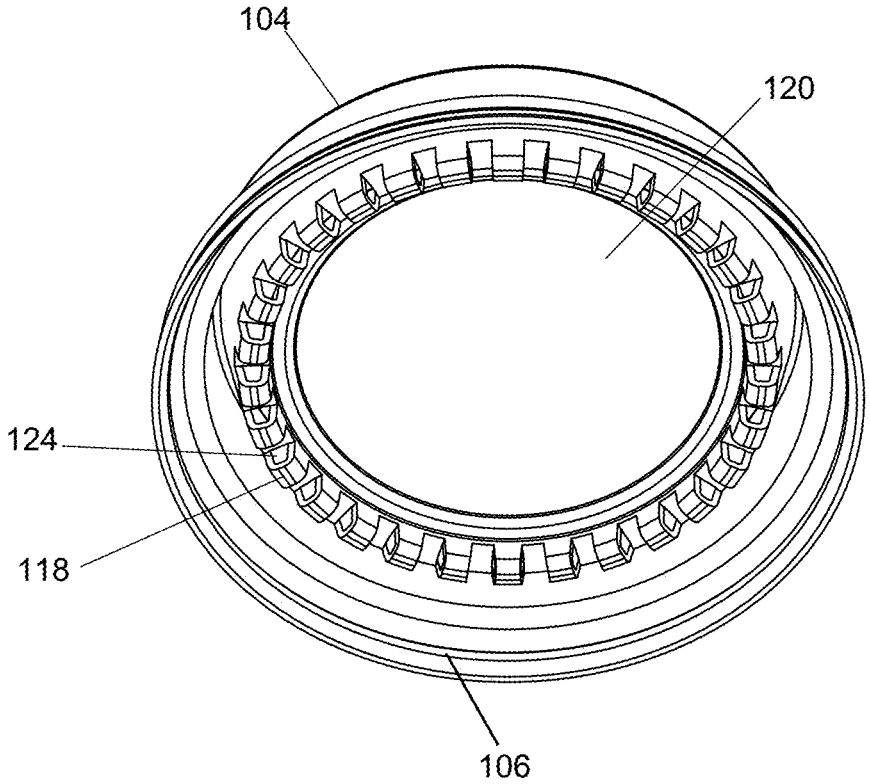
FIG. 3. is a bottom view of a lower lid of the embodiment shown in FIG. 1.
Figure 6:
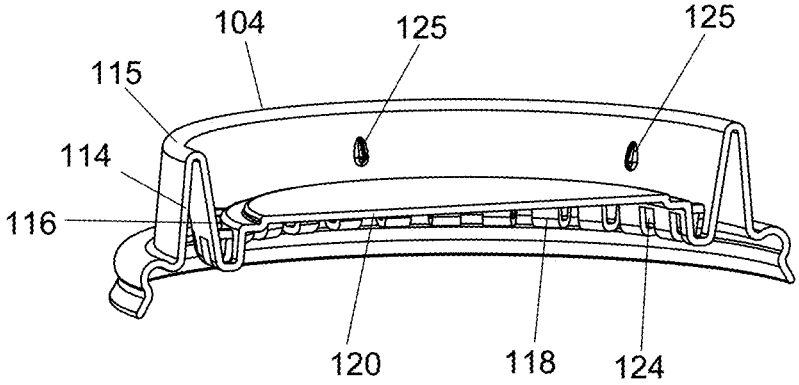
FIG. 6. is a cross section view of a lower lid of the embodiment shown in FIG. 1.
Figure 7:
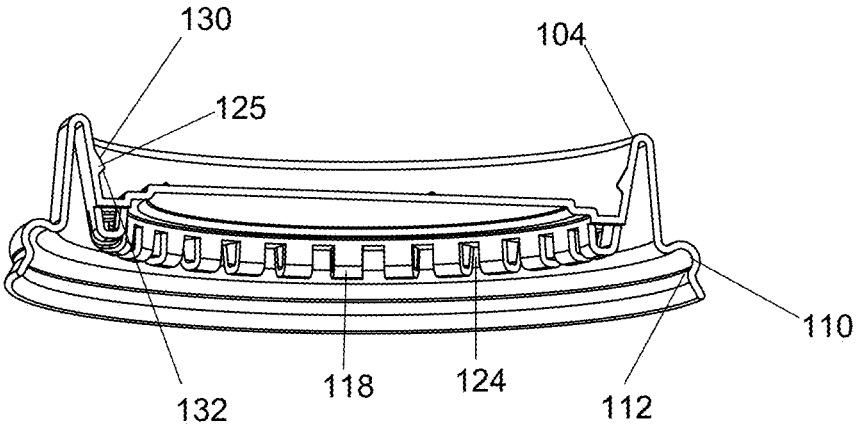
FIG. 7. is a cross section view of a lower lid of the embodiment shown in FIG. 1.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Referring to FIGS. 1-11, there is shown a lid 100 in accordance with an embodiment of the present invention operably connected to a conventional beverage container such as cup 20. Beverage cup 20 is well known in the art and typically comprises an upwardly flared body that terminates in an external beaded or rolled rim 22 as is well known in the art. Beverage cup 20 may be disposable, made of paper in which case the rim is usually of the rolled kind, or the cup may be reusable and of a thicker material in which case the rim may be a bead variety. These kinds of beverage cups are widely known and used in serving take out hot or cold beverages. The present invention may comprise any suitable numerous dimensions and configurations of lid.

The lids of the present invention may be made of a thin thermoplastic material which is relatively flexible but not relatively elastic, and may be of a size to fit the specific cup or container 20 for which it is intended.

Lid 100 comprises lower lid 104 and upper lid 102, which is positioned and nested within lower lid 104. The lids 104 and 102 are cooperatively dimensioned such that the upper lid 102 is positioned within an inside periphery of inside surface 113 of the lower lid 104 in an assembled configuration. The lid 100 may have a tab (not shown) extending from a portion of the lower lid 104 with an instruction display (not shown).

The lower lid 104 comprises a lower perimeter skirt 106, which extends around the upper rim 22 of the coffee cup 20. The skirt 106 includes a snap-fit locking mechanism comprised of an annular internal round channel 110 and an annular inwardly projecting edge portion 112 on the lower portion of the rounded channel 110 that is adapted to underlie and directly engage the bottom portion of the rim 22 of the container to retain the lid thereon. The rounded channel 110 has a cross section that closely conforms to the cross-sectional shape of the bead or rim 22 of an associated beverage cup or container 20, thereby the round channel is adapted to closely receive the rim 22 to provide a liquid tight seal there between. The configuration of the skirt 106 and its engagement with the bead 22 of the cup 20 is well known in the art.

Spaced a short distance radially inwardly from the perimeter skirt 106, is a raised perimeter lip portion 108 comprising an outer perimeter wall 114 having an upward and radially inward slant, a narrow top horizontal perimeter wall 115 extending radially inwardly from the outer wall 114, and then a downwardly extending, inwardly facing inner perimeter wall 116 that defines the inward facing surface 113. The narrow top horizontal perimeter wall 115 may be rounded in cross-section.

Radially inward from the inner perimeter wall 116 is defined an annular portion such as trough 118, and radially inward from the trough 118 is a central horizontal disk portion 120. In the illustrated embodiment, the horizontal disk portion 120 defines a shoulder 122, though in other embodiments the shoulder may be omitted. The annular trough 118 is provided with a plurality of openings or holes 124 positioned around the periphery through which the liquid contents of the cup 20 may flow. The openings 124 can consist of different shapes such as square, rectangular and the like. Preferably, the horizontal disk portion 120 has a slight convex domed shape to facilitate the runoff of any stray liquid towards the opening holes 124 around the perimeter of the trough 118.

The lower lid 104 includes as stop mechanism such as a plurality of protrusions or stop members 125 positioned on the inside surface 113 of the lip portion 108. The bottom of the stop members 125 lie in a horizontal plane that is above the plane of the horizontal surface of disk portion 120. The upper surface 130 of the stop members 125 are tapered to merge with the inside surface 113 of the lower lid 104, while the bottom surface 132 of the stop members 125 are more abruptly angled toward the inside surface 113.

Figure 10:
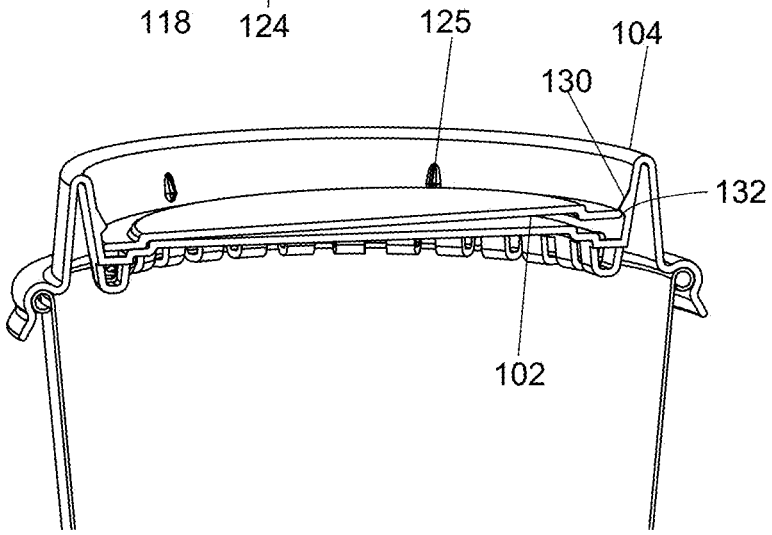
FIG. 10. is a cross section view of an upper lid seated on a lower lid of the embodiment shown in FIG. 1 in an open configuration, mounted on the rim of a cup.

The upper lid 102 comprises a disk member that is sized and shaped to rest on top of the horizontal portion 120 the lower lid 104 such that its peripheral edge 126 abuts the inside surface 113 of the inner perimeter wall 116 of the lip portion 108. Accordingly, the outer perimeter portion of the upper lid 102 covers the annular trough 118 and the holes 124. Thus, when the upper lid 102 rests on top of the central horizontal portion 120 of the lower lid 104, the holes 124 are covered and inadvertent splashing of the liquid contents out of the cup is prevented (as shown in FIG. 5). The upper lid 102 has a vertical range of movement defined by the abrupt bottom surface 132 of the stop members 125, and the distance between the plane of the bottom of the stop members 125 and the plane of the horizontal surface 120 is such as to accommodate the thickness of the peripheral edge 126 of the upper lid 102 as well as allow some upward movement of the upper lid 102 to provide some clearance for the flow of liquid out of the cup via the opening holes 124 when the adjacent edge 126 of the upper lid 102 abuts the bottom of the nearby stop members 125 (as shown in FIG. 10). The tapered upper surface 130 of the stop members 125 facilitates the assembly of the closely conforming upper lid 102 onto the lower lid 104 as the tapered upper surfaces facilitate the edge 126 of the upper lid to pass by as a result of deflection the inner wall 116 adjacent the stop members, and after assembly the upper lid 102 is retained in position by the abrupt lower surfaces 132 of stop members 125.

As the illustrated embodiment of the horizontal portion 120 of the lower lid 104 includes the shoulder 122, the upper lid 102 also includes a complementary shoulder 128 that enables the upper lid 102 to closely nest on top of horizontal portion 120 of the lower lid 104. In addition, the central areas of the upper lid and the lower lid have a slight upward domed shape to facilitate the flow of liquid towards the trough to minimize pooling of stray liquid in the lid. In other embodiments, these shoulders may be omitted such that a planar or slightly domed upper lid rests on top of a planar or slightly domed horizontal portion.

Figure 8:
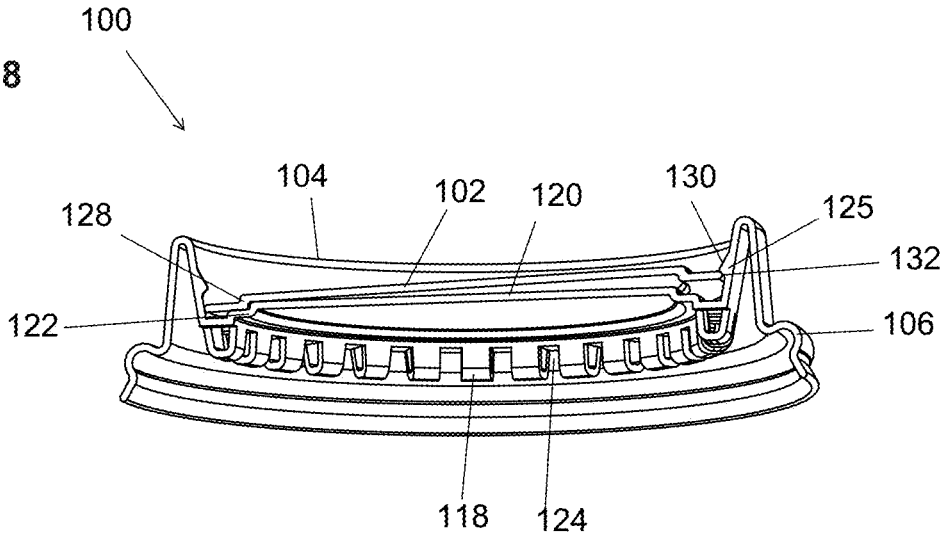
FIG. 8. is a cross section view of an upper lid seated on a lower lid of the embodiment shown in FIG. 1 in an open configuration.
Figure 9:
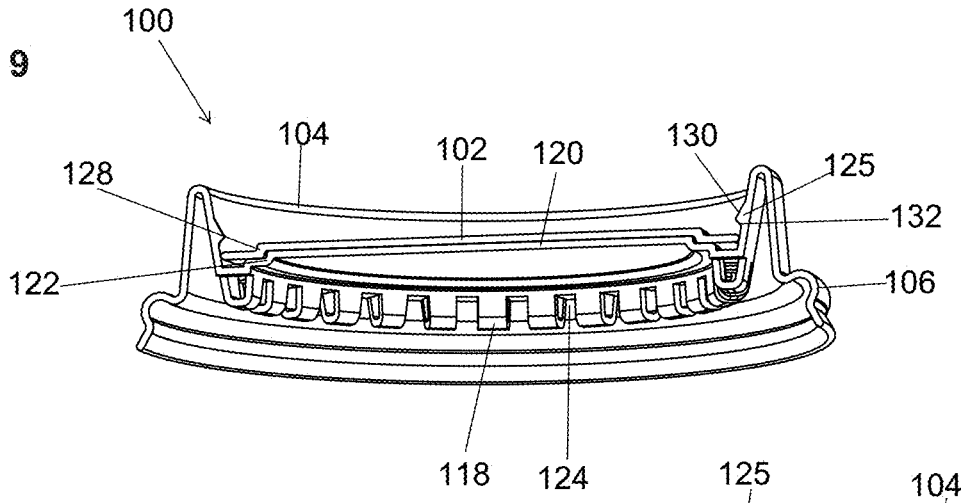
FIG. 9. is a cross section view of an upper lid seated on a lower lid of the embodiment shown in FIG. 1 in a closed configuration.

Referring to FIGS. 8 and 9, the lower lid 104 and the upper lid 102 of the lid 100 are shown in open and closed configurations respectively. In a closed configuration of FIG. 9, the upper lid 102 rests closely on top of the horizontal surface 120 of the lower lid 104 by gravity, and the peripheral edge portion of the upper lid 102 covers the annular trough 118 and the opening holes 124. Thereby, in the closed configuration, the liquid contents of the cup 20 is prevented from splashing out of the cup via the openings 124 as a result of the peripheral edge portion of the upper lid 102 covering the holes. When the cup 20 is tilted such as when a user wishes to drink its contents, the liquid contents flows as a result of gravity the towards the lower portion of the lid 100 and flows through the holes 124. The pressure of the liquid flow through the holes 124 acts upon the adjacent peripheral edge portion of the upper lid 102 and deflects the edge portion outward. The range of movement provided by the vertical distance of the nearby bottom surfaces 132 of the stop members 125 allows for the upward displacement of the peripheral edge 126 of the upper lid 102 sufficient to allow a flow of liquid past out of the holes 124 and past the peripheral edge 126 of the upper lid 102 as shown in FIGS. 8 and 10.

Drain holes 137 and 138 are located in the center horizontal surface or area 120 of the upper lid 102 and the lower lid 104 to facilitate drainage of any liquid remaining over the upper lid 102 back into the cup 20 once the cup is returned to an upright configuration and the lid is in a closed configuration. The lid 100 may also contain drop opening hole (not shown) to collect liquid and to drop back the liquid into the cup on the upper lid.

Advantageously the perimeter lip portion 108 in combination with the opening holes 124 around the perimeter of the annular trough 118 allows a user to drink from all side of the lid 100, unlike some conventional lids which have only one drinking hole and requires the user to locate the whole prior to drinking the contents of the cup. While this may be a minor inconvenience in situations not requiring the attention of the user, it is a more significant inconvenience when the user is concentrating on other tasks or when the level of light in the environment is low, such as for example drinking coffee while driving at night.

Figure 11:
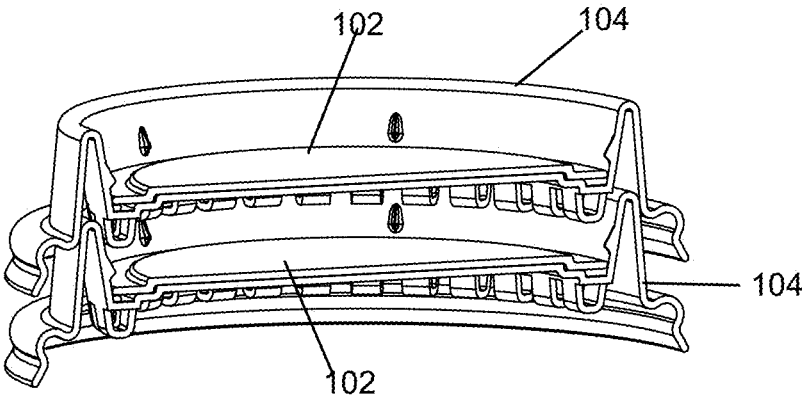
FIG. 11. is a cross section view of stacked lids of the embodiment shown in FIG. 1.

As shown in FIG. 11 the lids 100 are designed for stackability to save on storage space.

The upper surface of the upper lid 102 on lid 100 provides a platform on which advertising messages 119 may be placed, for example of any product and services of a fast food restaurant. The message materials (not shown) can be written or printed in a paper, plastic, transparent screen materials and the like which can be placed on the upper lid using different labeling processes. Preferably the advertising message may be molded into the lid material by in-mold labeling processes. Other materials can be used such as transparent LED display, see-through LED screen, transparent hologram screen film, transparent LCD, flexible image display, digital screen and the like. This advertising medium is beneficial for fast food restaurants to advertise or promote their products and services using the center areas by simply printing advertising messages using removable or permanent stickers, printed messages on the lids, and using in-mold labeling (IML) processes for high volume and to save printing costs. Other method of utilizing the center areas can be using peel-off stickers, scratch & win stickers, grand prize stickers and the like. Further, the various components of labeling can be made of different materials and by any suitable manufacturing processes. Other advertising labeling for example can be using invisible or changeable plastic materials, electronic LCD or LED displays, 3D displays and the like. The enclosable lid 100 can be made to any size, shape and designed required by fast food industry, beverage companies and the like. The center areas can be useful for fast food restaurants or others to utilize the space for various purposes such as product launch, branding, awareness, promotion, employment opportunity, grand prizes, interactive games and the like. In another instance, third party companies such as telephone or utilities in cooperation with a fast food restaurant or coffee companies as a cross promotion can advertise on the lid to promote their brand awareness. For example, a fast food restaurant can provide discounts with the promotional messages and these discounts can be redeemed by a customer on his or her next purchase by submitting the lid to cashiers at any participating fast food restaurants.

Figure 12:
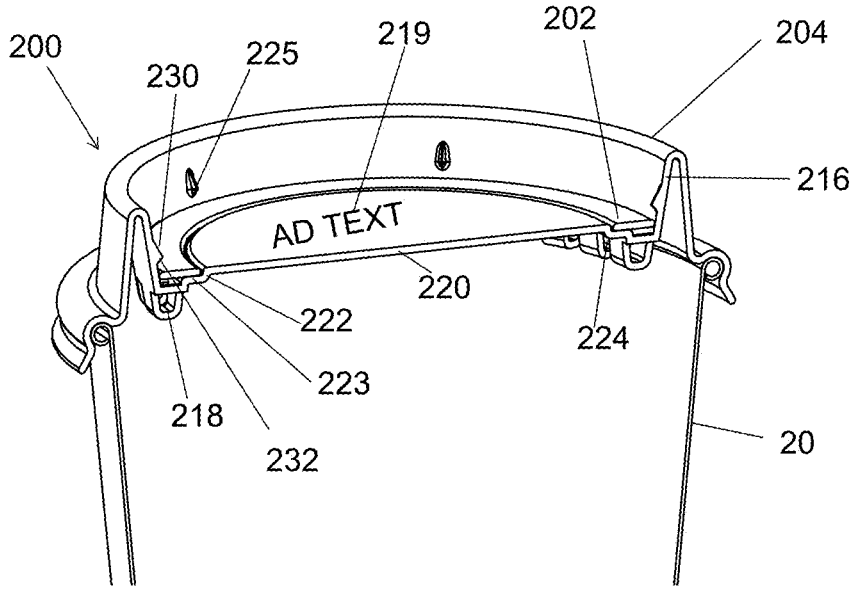
FIG. 12. is a perspective view of a lid for beverage cup in accordance with another embodiment of the present invention.
Figure 13:
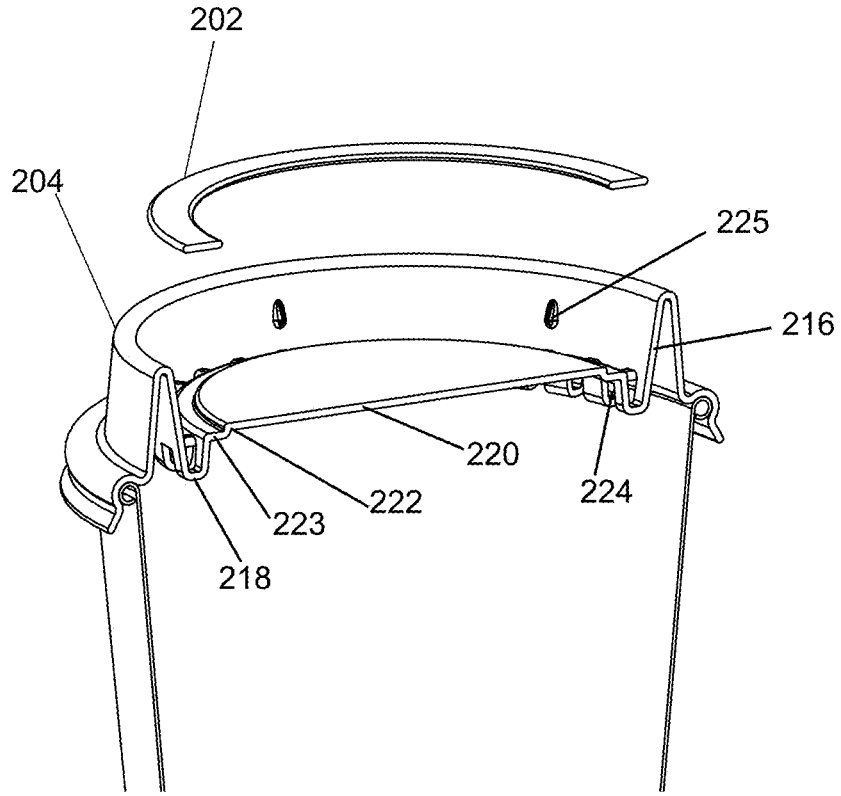
FIG. 13. is a sectional view of the embodiment shown in FIG. 12 with the upper planar annular member shown exploded from the lower lid.

Referring to FIGS. 12 and 13, there is shown a lid 200 in accordance with another embodiment of the present invention operably connected to a conventional beverage container such as cup 20. Lid 200 comprises lower lid 204 that is very similar in construction to lower lid 104 described above. Instead of an upper lid 102, lid 200 has a planar annulus 202 that rests on a horizontal ledge 223 located radially inward from the annular trough 218 and the planar annulus 202 extends between the shoulder 222 and the inward facing surface 213 to cover the opening holes 224 in the annular trough 218. The planar annulus 202 functions similarly to the upper lid 102 in that when the planar annulus 202 rests on top of the horizontal ledge 223 of the lower lid 104, the holes 224 are covered and inadvertent splashing of the liquid contents out of the cup is prevented (as shown in FIG. 12). The planar annulus 202 has a vertical range of movement defined by the abrupt bottom surface 232 of the stop members 225, and the distance between the plane of the bottom of the stop members 225 and the plane of the horizontal surface 220 is such as to accommodate the thickness of the peripheral edge 226 of the planar annulus 202 as well as allow some upward movement of the planar annulus 202 to provide some clearance for the flow of liquid out of the cup via the opening holes 224 when the adjacent edge 226 of the planar annulus 202 abuts the bottom of the nearby stop members 225. The tapered upper surface 230 of the stop members 225 facilitates the assembly of the closely conforming planar annulus 202 onto the lower lid 204 as the tapered upper surfaces facilitate the edge 226 of the planar annulus to pass by as a result of deflection the inner wall 216 adjacent the stop members, and after assembly the planar annulus 202 is retained in position by the abrupt lower surfaces 232 of stop members 225.

In a closed configuration, the planar annulus 202 rests closely on top of the horizontal surface 220 of the lower lid 204 by gravity, and the peripheral edge portion of the planar annulus 202 covers the annular trough 218 and the opening holes 224. Thereby, in the closed configuration, the liquid contents of the cup 20 is prevented from splashing out of the cup via the openings 224 as a result of the peripheral edge portion of the planar annulus 202 covering the holes. When the cup 20 is tilted such as when a user wishes to drink its contents, the liquid contents flows because of gravity the towards the lower portion of the lid 200 and flows through the holes 224. The pressure of the liquid flow through the holes 224 acts upon the adjacent peripheral edge portion of the planar annulus 202 and deflects the edge portion upward. The range of movement provided by the vertical distance of the nearby bottom surfaces 232 of the stop members 225 allows for the upward displacement of the peripheral edge 226 of the planar annulus 202 sufficient to allow a flow of liquid past out of the holes 224 and past the peripheral edge 226 of the planar annulus 202.

The upper surface of horizontal portion 220 on the lower lid 204 provides a flat platform on which advertising messages 219 may be placed as described above.

Figure 14:
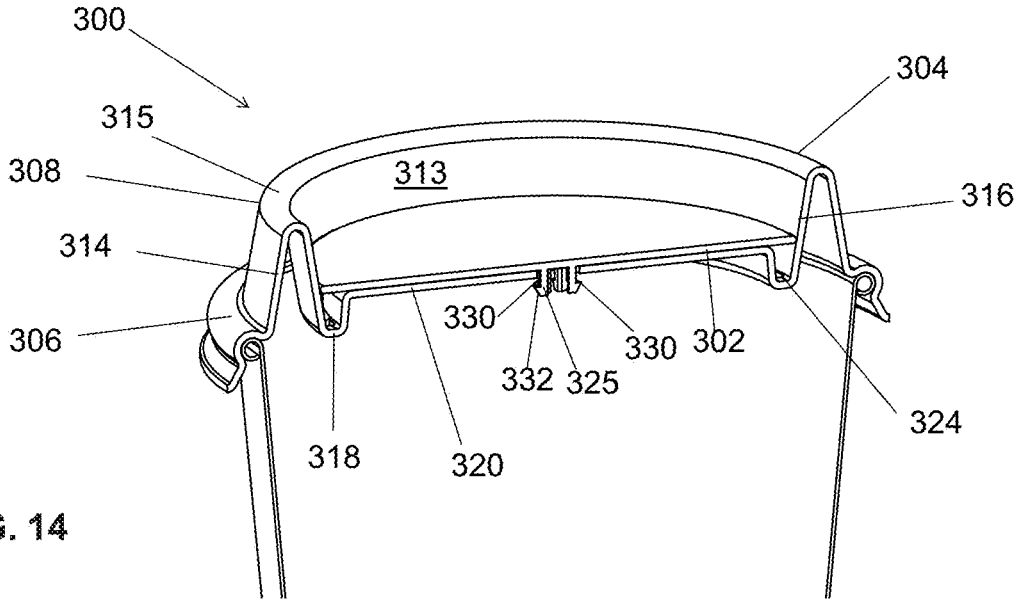
FIG. 14. is a sectional view of a lid for beverage cup in accordance with another embodiment of the present invention.
Figure 15:
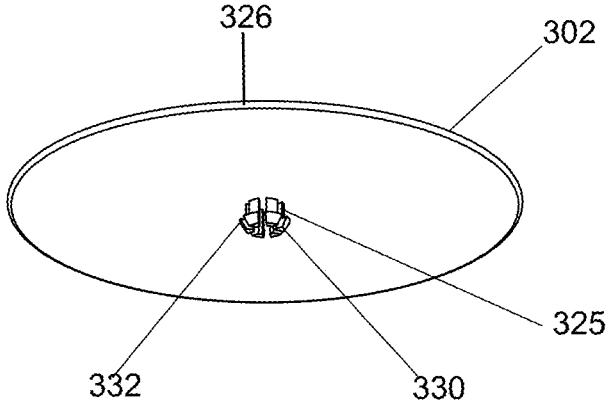
FIG. 15. is a bottom perspective view of an upper lid of the embodiment shown in FIG. 14.
Figure 16:
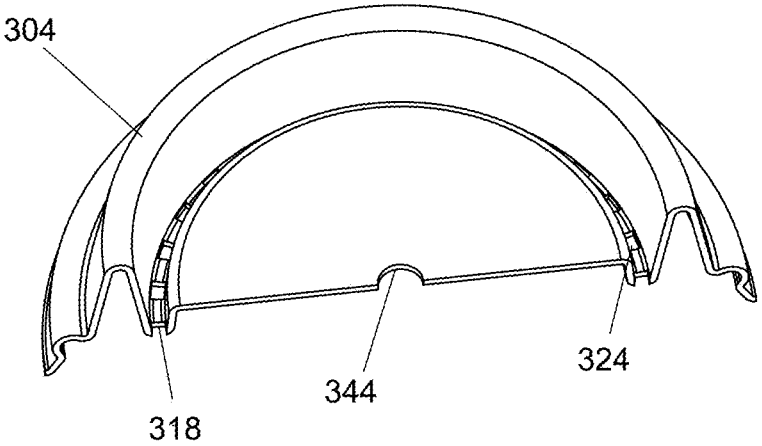
FIG. 16. is a sectional view of a lower lid of the embodiment shown in FIG. 14.
Figure 17:
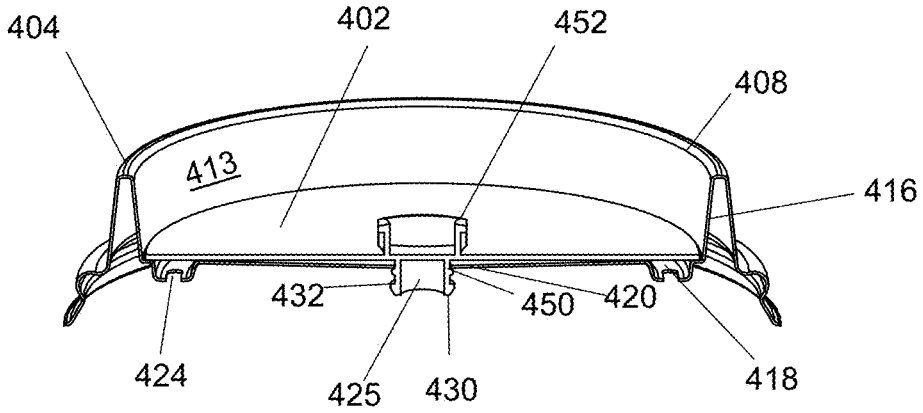
FIG. 17. is a sectional view of a lid for beverage cup in accordance with another embodiment of the present invention.

Referring to FIGS. 14-16, there is shown a lid 300 in accordance with another embodiment of the present invention operably connected to a conventional beverage container such as cup 20. Lid 300 comprises lower lid 304 that is very similar in construction to lower lid 104 described above, and an upper lid 302.

The lower lid 304 comprises a lower perimeter skirt 306, which extends around the upper rim 22 of the coffee cup 20 and engages there with to provide a secure attachment of the lower lid to the cup 20. The configuration of the skirt 306 and its engagement with the bead 22 of the cup 20 is well known in the art. Spaced a short distance radially inwardly from the perimeter skirt 306, is a raised perimeter lip portion 308, comprising an outer perimeter wall 314 having an upward and radially inward slant, a narrow top horizontal perimeter wall 315 extending radially inwardly from the outer wall 314, and then a downwardly extending, inwardly facing inner perimeter wall 316 that defines the inward facing surface 313. The narrow top horizontal perimeter wall 315 is rounded in cross-section.

Radially inward from the inner perimeter wall 316 is defined an annular portion such as trough 318, and radially inward from the trough 318 is horizontal portion 320 having a generally circular configuration. The annular trough 318 is provided with a plurality of opening holes 324 positioned around the periphery through which the liquid contents of the cup 20 may flow. The opening holes can consist of different shapes such as square, rectangular and the like. Located centrally on the planar horizontal portion 320 is a hole 344.

The upper lid 302 comprises a generally planar disk member that is sized and shaped to rest on top of the horizontal portion 320 the lower lid 304 such that its peripheral edge 326 abuts the inside surface 313 of the inner perimeter wall 316 of the lip portion 308. Accordingly, the outer perimeter portion of the upper lid 302 covers the annular trough 318 and the holes 324. Thus, when the upper lid 302 rests on top of the central horizontal portion 320 of the lower lid 304, the holes 324 are covered and inadvertent splashing of the liquid contents out of the cup is prevented (as shown in FIG. 14).

The bottom surface of the upper lid 302 includes as stop mechanism such as centrally located protrusions or stop members 325 that are arranged in a cylindrical configuration that is sized to fit within the hole 344 of the lower lid 304. Each stop number 325 extends outwardly at its terminal end to define an abrupt upward facing surface 332 and the tapered downward facing surface 330. The cylindrical configuration of the stop members 325 is adapted to pass through the hole 344 of the lower lid 304 in that the tapered lower surface 332 of each stop members 325 deflects stop member inward as it passes the edge of the hole 344, and once the enlarged portions of the stop member passes through the whole, the stop member springs back into its original configuration and the abrupt surface 332 prevents stop members 325 from being withdrawn from the holes 344. The stop members are sized such that the abrupt surface 332 accommodates the width of the horizontal portion 320 as well as to allow some upward movement of the upper lid 302. Hence the upper lid 302 has a vertical range of movement defined by the abrupt upper surface 332 of the stop members 325 and the upper lid 302 is thereby capable of pivoting within its range of motion relative to the lower lids 304. The ability for the upper lid 302 to pivot provides some clearance for the flow of liquid out of the cup via the opening hole 324 when the cup with the lid 300 is tilted so that pressure from the flow of liquid past the opening 324 pushes the adjacent edge 326 of the upper lid 302 outwards until the stop members 325 on the same side abuts the edge of hole 344. The tapered lower surfaces 330 of the stop members 325 facilitates the assembly of the closely conforming upper lid 302 onto the lower lid 304 as the tapered lower surfaces facilitate the hole 344 of the lower lid to pass by as a result of deflection the stop members 326 inwards, and after assembly the upper lid 302 is retained in position by the abrupt upper surfaces 332 of stop members 325.

Figure 18:
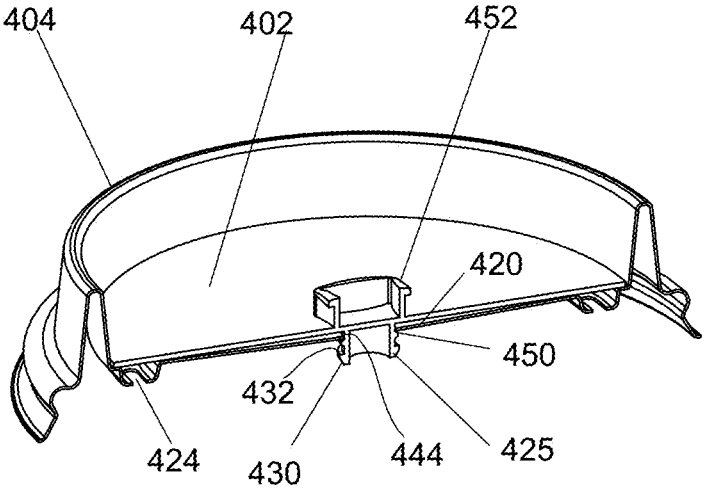
FIG. 18. is a sectional view of the embodiment shown in FIG. 17.
Figure 19:
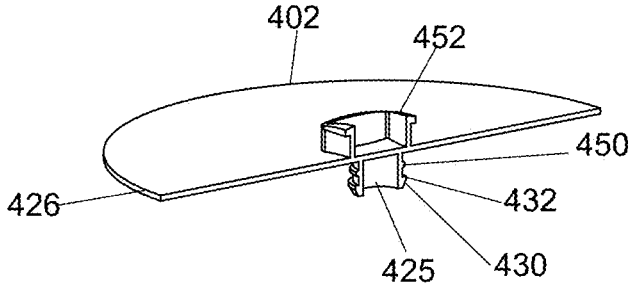
FIG. 19. is a sectional view of an upper lid of the embodiment shown in FIG. 17.

Referring to FIGS. 17-20, there is shown a lid 400 in accordance with another embodiment of the present invention for being operably connected to a conventional beverage container such as cup 20. Lid 400 comprises lower lid 404 that is very similar in construction to lower lid 304 described above. The upper lid 402 comprises a generally planar disk member that is sized and shaped to rest on top of the horizontal portion 420 the lower lid 404 such that its peripheral edge 426 abuts the inside surface 413 of the inner perimeter wall 416 of the lip portion 408. Accordingly, the outer perimeter portion of the upper lid 402 covers the annular trough 418 and the holes 424. Thus, when the upper lid 402 rests on top of the central horizontal portion 420 of the lower lid 404, the holes 424 are covered and inadvertent splashing of the liquid contents out of the cup is prevented (as shown in FIG. 18). The bottom surface of the upper lid 402 has a stop mechanism such as centrally located cylindrical protrusion or stop member 425 that is sized to fit within the hole 444 of the lower lid 404. The stop member 425 terminates in an enlarged portion that defines an abrupt upward facing surface 432 and the tapered downward facing surface 430. The cylindrical configuration of the stop members 425 is adapted to pass through the hole 444 of the lower lid 404 in that the tapered lower surface 430 deflects the stop member inward as it passes the edge of the hole 444, and once the enlarged portions of the stop member passes through the whole, the stop member springs back into its original configuration and the abrupt surface 430 prevents stop members 425 from being withdrawn from the hole 444.

The stop member is sized such that the abrupt surface 432 accommodates the width of the horizontal portion 420 as well as to allow some upward movement of the upper lid 402. Hence the upper lid 402 has a vertical range of movement defined by the abrupt upper surface 432 of the stop members 425 and the upper lid 402 is thereby capable of pivoting within its range of motion relative to the lower lids 404. The ability for the upper lid 402 to pivot provides some clearance for the flow of liquid out of the cup via the opening holes 424 when the cup with the lid 400 is tilted so that pressure from the flow of liquid past the opening 424 pushes the adjacent edge 426 of the upper lid 402 outwards until the stop members 425 on the same side abuts the edge of hole 444. The tapered lower surfaces 430 of the stop members 425 facilitates the assembly of the closely conforming upper lid 402 onto the lower lid 404 as the tapered lower surfaces facilitate the hole 444 of the lower lid to pass by as a result of deflection the stop members 426 inwards, and after assembly the upper lid 402 is retained in position by the abrupt upper surfaces 432 of stop members 425.

The stop member 425 additionally includes a second peripheral annular enlarged portion 450 that is located proximal to the base of the stop member 425 near the bottom surface of the upper lid 402. The enlarged portion 450 is sized to be slightly larger than the diameter of the hole 444 and is spaced away from the bottom surface of the upper lid 402 a distance to just accommodate the thickness of the horizontal portion 420 of the lower lid 404. The upper surface of the upper lid 402 further includes a centrally located grip member 452 located opposite of the stop member 425. The upper lid 402 may thus be releasably locked into a closed configuration as result of downward force applied to the grip member 452 causing the enlarged portion 450 to slide through the hole 444 thereby capturing the portion of the lower lid surrounding the hole 444 between the enlarged portion 450 and the bottom surface of the upper lid 402. The upper lid 402 may be unlocked by upward force applied to the grip member 452 causing the enlarged portion 450 to be withdrawn from the hole 444 of the lower lid 404 thereby locating the edge portion adjacent the hole between the enlarged portion 450 and the abrupt surface 432 of the stop member 452 which enables a range of motion through which the upper lid 402 is able to tilt with respect to the lower lid 404 to enable an edge of the upper lid to be displaced by the flow of liquid out of the cup, as described herein with respect to lid 300.

Figure 20:
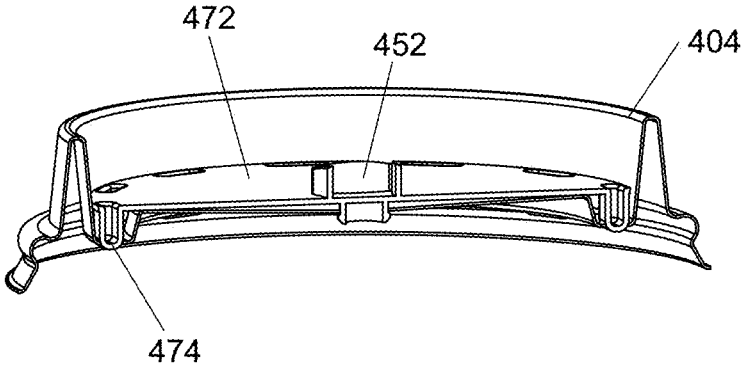
FIG. 20. is a sectional view of a lid for beverage cup in accordance with another embodiment of the present invention.
Figure 21:
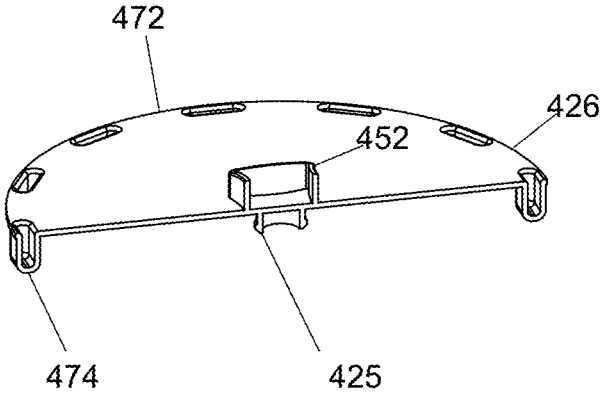
FIG. 21. is a sectional view of an upper lid of the embodiment shown in FIG. 20.

Referring to FIGS. 20 and 21, there is shown another embodiment of an upper lid 472 that is very similar to the upper lid 402 with the addition of a plurality of downwardly extending plug members 474 around the periphery of the lower surface adjacent the perimeter edge 426 of the upper lid 472. Each plug member corresponds to an opening hole 424 on the lower lid 404 and is adapted to partially fit within its adjacent opening hole 424 to obstruct the opening hole and prevent liquid flowing through said hole. A user aligns the plug members 474 with the corresponding opening holes 424 and then presses the grip member 452 downward to place the upper lid 472 in a locked configuration. The interference of the plug members 474 with its adjacent opening hole 424 provides a more secure resistance to liquid flowing unintentionally from the cup. The upper lid 472 may be placed in an unlocked configuration by a user pulling upward on the grip member 452 to release the upper lid 472, and then rotate the upper lid such that the plug members 474 are moved out of alignment with the opening holes 424 and rest on the bottom of the annular trough 418. Thereby liquid can flow out of the opening holes 424 so that a user may drink the contents of cup.

Figure 22:
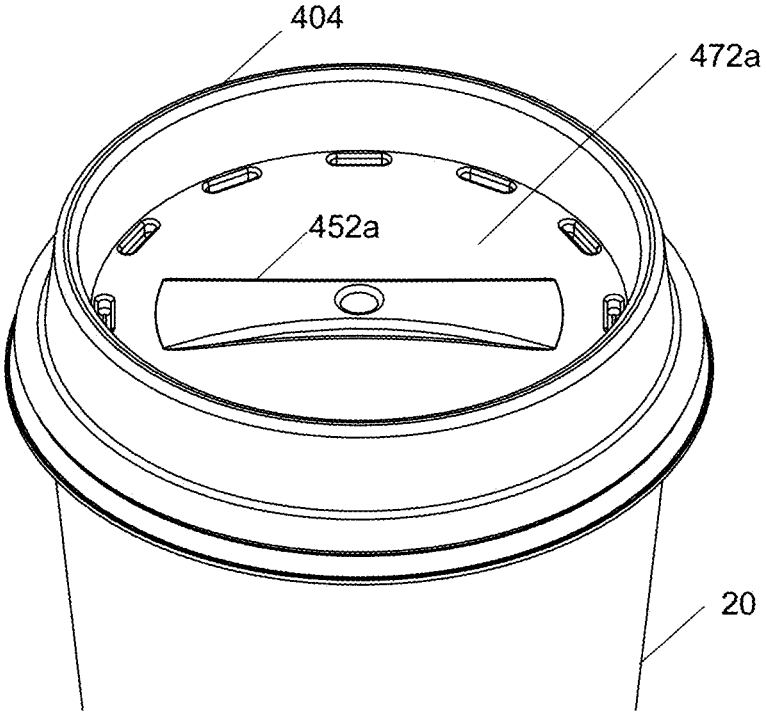
FIG. 22. is a perspective view of the lid of the embodiment shown in FIG. 20.
Figure 23:
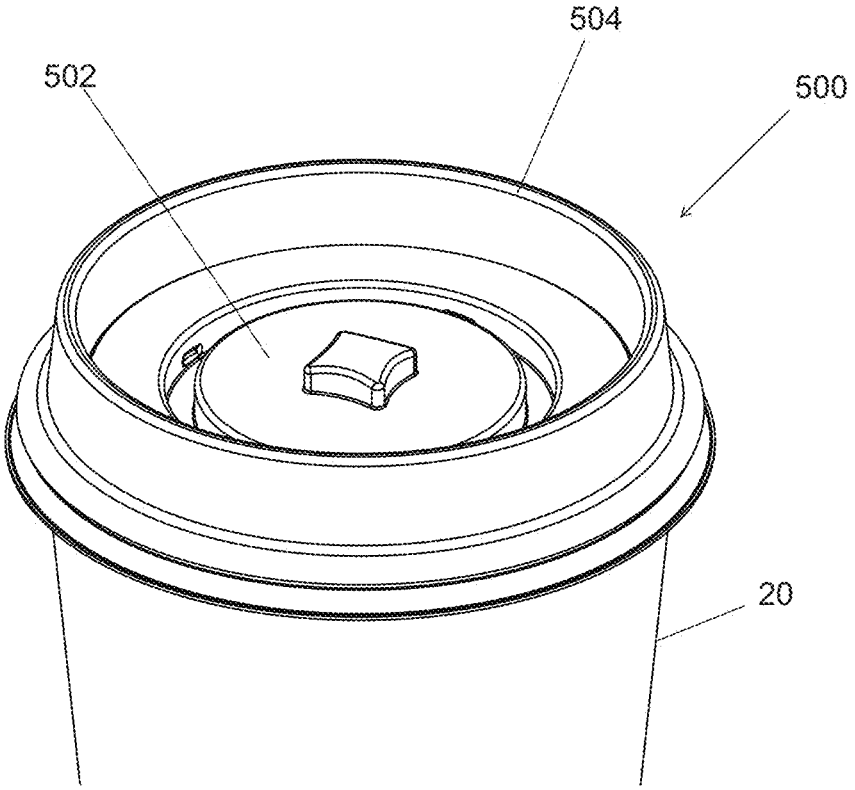
FIG. 23. is a perspective view of a lid for beverage cup in accordance with another embodiment of the present invention.
Figure 24:
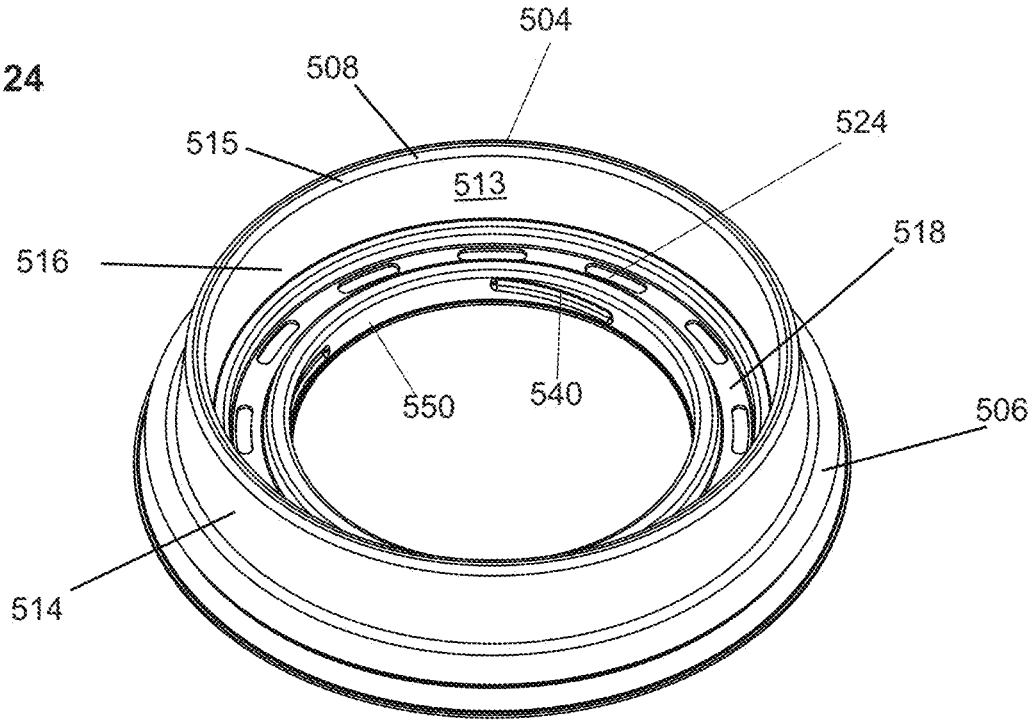
FIG. 24. is a perspective view of a lower lid of the embodiment shown in FIG. 23.
Figure 25:
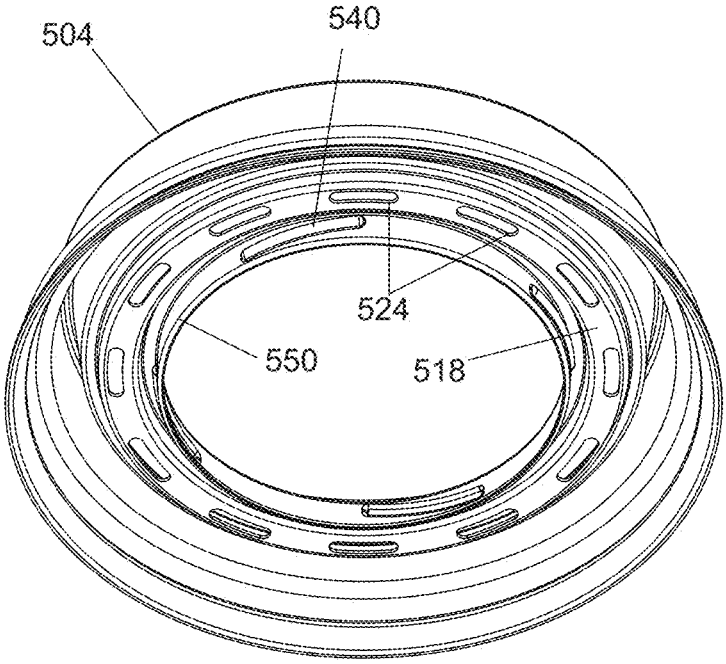
FIG. 25. is a perspective view from the bottom of a lower lid of the embodiment shown in FIG. 23.
Figure 26:
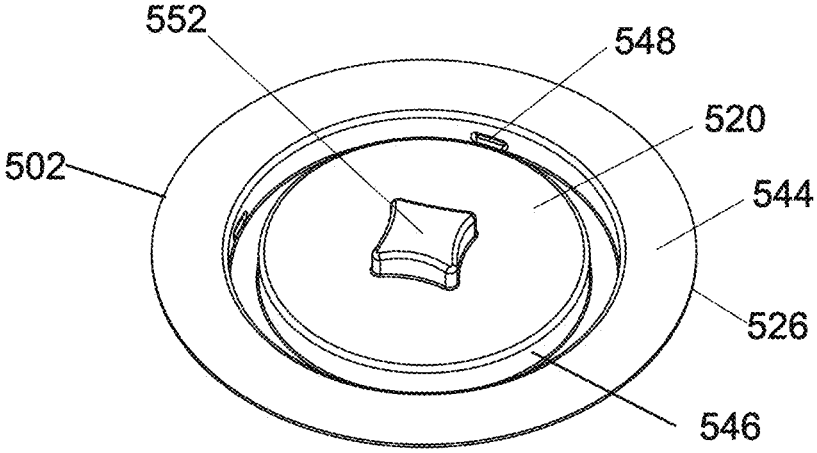
FIG. 26. is a perspective view of an upper lid of the embodiment shown in FIG. 23.
Figure 27:
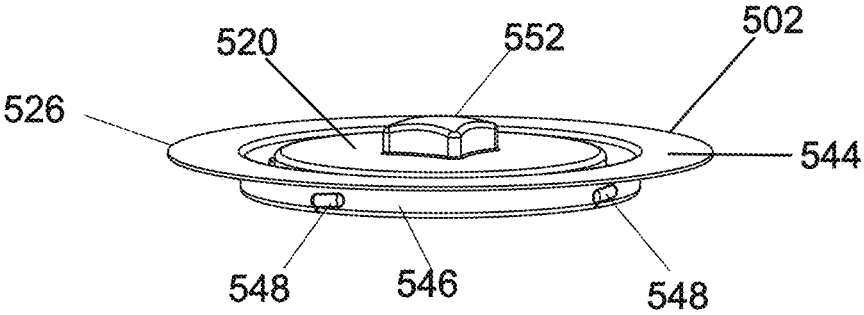
FIG. 27. is a perspective view of an upper lid of the embodiment shown in FIG. 23.
Figure 28:
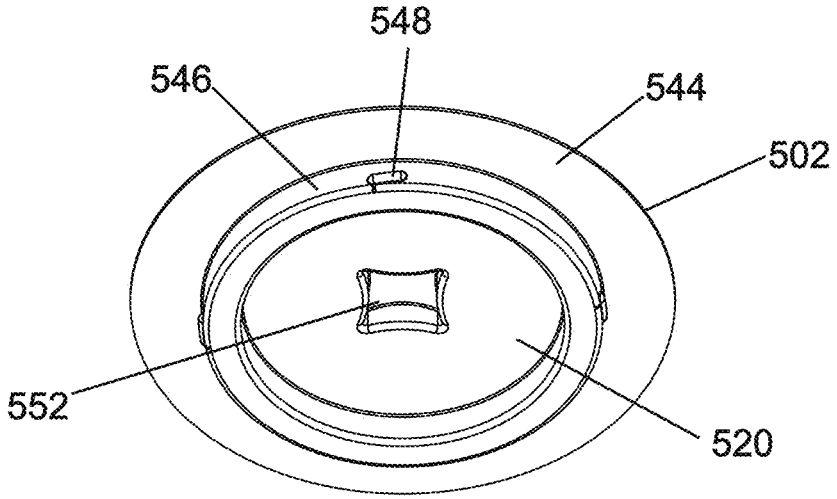
FIG. 28. is a perspective view from the bottom of an upper lid of the embodiment shown in FIG. 23.
Figure 29:
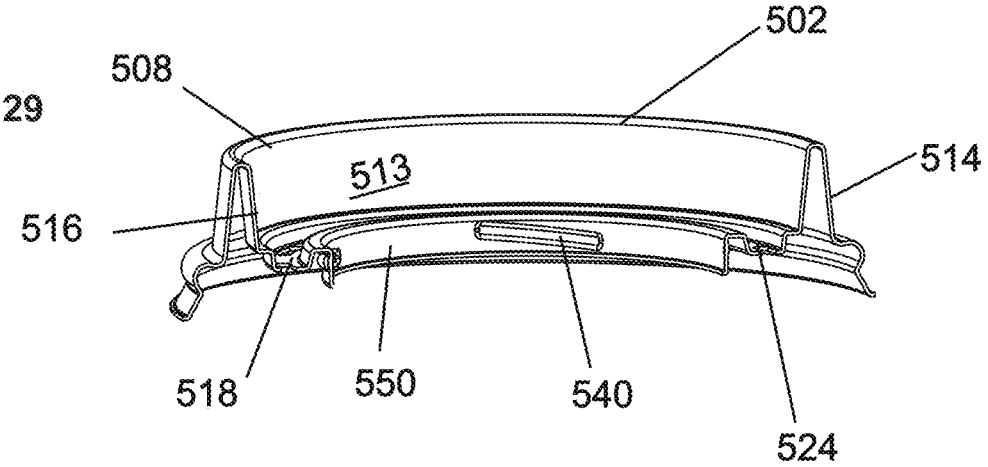
FIG. 29. a sectional view of a lower lid of the embodiment shown in FIG. 23.
Figure 30:
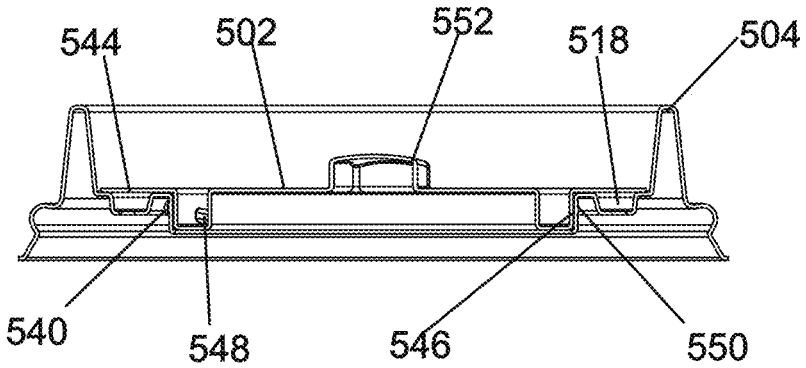
FIG. 30. a sectional view of the embodiment shown in FIG. 23 in a closed configuration.

Referring to FIG. 22, there is shown a variant of the upper lid 472*a* which is very similar to upper lid 472 except that the grip member 452*a* is elongate and extends across a substantial portion of diameter of the upper lid 472*a* and thereby provides a better grip by which the upper lid may be rotated.

Referring to FIGS. 23-35, there is shown a lid 500 in accordance with another embodiment of the present invention for being operably connected to a conventional beverage container such as cup 20. The lid 500 is comprises lower lid 504 and upper lid 502, which is positioned and nested onto lower lid 504. The lids 504 and 502 are cooperatively dimensioned such that the upper lid 502 is positioned within an inside periphery 513 of the lower lid 504 in an assembled configuration.

The lower lid 504 comprises a lower perimeter skirt 506, which extends around the upper rim 22 of the coffee cup 20. The skirt 506 includes a snap-fit locking mechanism comprised of an annular internal round channel and an annular inwardly projecting edge portion on the lower portion of the rounded channel that is adapted to underlie and directly engage the bottom portion of the rim 22 of the container to retain the lid thereon and provide a secure attachment of the lower lid to the cup 20. The configuration of the skirt 506 and its engagement with the bead 22 of the cup 20 is well known in the art.

Spaced a short distance radially inwardly from the perimeter skirt 506, is a raised perimeter lip portion 508, comprising an outer perimeter wall 514 having an upward and radially inward slant, a narrow top horizontal perimeter wall 515 extending radially inwardly from the outer wall 514, and then a downwardly extending, inwardly facing inner perimeter wall 516 that defines the inward facing surface 513. The narrow top horizontal perimeter wall 515 may be rounded in cross-section.

Radially inward from the inner perimeter wall 516 is defined an annular portion such as trough 518 having a plurality of opening holes 524 positioned around the periphery through which the liquid contents of the cup 20 may flow. The opening holes may consist of different shapes such as square, rectangular and the like.

Radially inward from the trough 518 is perimeter vertical wall portion 550 in which are defined channels 540 that are angled to extend from the bottom of the vertical wall portion towards the top thereof.

The upper lid 502 includes an outer planar annular member 544 that is sized such that its peripheral edge 526 fits within and abuts the inside surface 513 of the inner perimeter wall 516 of the lip portion 508 of the lower lid 504. Radially inward from the annular member 544 is a vertical cylindrical wall portion 546 that is sized to closely fit within vertical wall portion 550 of the lower lid 504. Protrusions 548 are provided on the outer surface of the vertical wall portion 546 and the protrusions 548 are spaced around the perimeter of the vertical wall portion 546 to correspond with the location of the channels 540 of the vertical wall portion 550 of the lower lid 504. The protrusions 548 are configured to fit within the channels 540 and to travel within the channels as the upper lid 502 is rotated relative to the lower lid 504.

Radially inward from the vertical wall portion 546 is a horizontal central disc portion 520 from which extends a centrally located grip member 552.

As can be seen from the figures, the upper lid 502 is configured to be received within the lower lid 504 such that their respective vertical wall portions 546 and 550 are in close proximity and the protrusions 548 travel within the channels 540. In such assembled configuration, the peripheral edge 526 of the upper lid 502 is in close proximity or abuts the inside surface 513 of the lip portion 508 of the lower lid 504, and the planar annular member 544 covers the trough 518 and its holes 524. Rotation of the upper lid 502 in one direction (counterclockwise in the illustrated embodiment) causes the upper lid 502 to rise with respect to the lower lid 504 as the protrusions 548 move upward along the vertical wall portions as they travel within the channels 540. This produces a gap between the planar annular member 540 and inside surface 513 of the lip portion 508 and provides clearance through which the liquid contents of the cup may flow outward via the openings 524 in the trough 518 thereby enabling the user to drink the contents of the cup. Rotation of the upper lid 502 in the opposite direction (clockwise in the illustrated embodiment) causes the upper lid 502 to lower with respect to the lower lid 504 as the protrusions 548 move downward along the vertical wall portions as they travel within channels 540. This eliminates the gap between the planar annular member 540 and the inside surface 513 of the lip portion 508 to effectively cover the trough 518 and the opening holes 524. In this closed configuration, the liquid contents of the cup is prevented from inadvertently flowing out. These structures also function as a stop mechanism that retains the upper lid connected to the lower lid.

Figure 34:
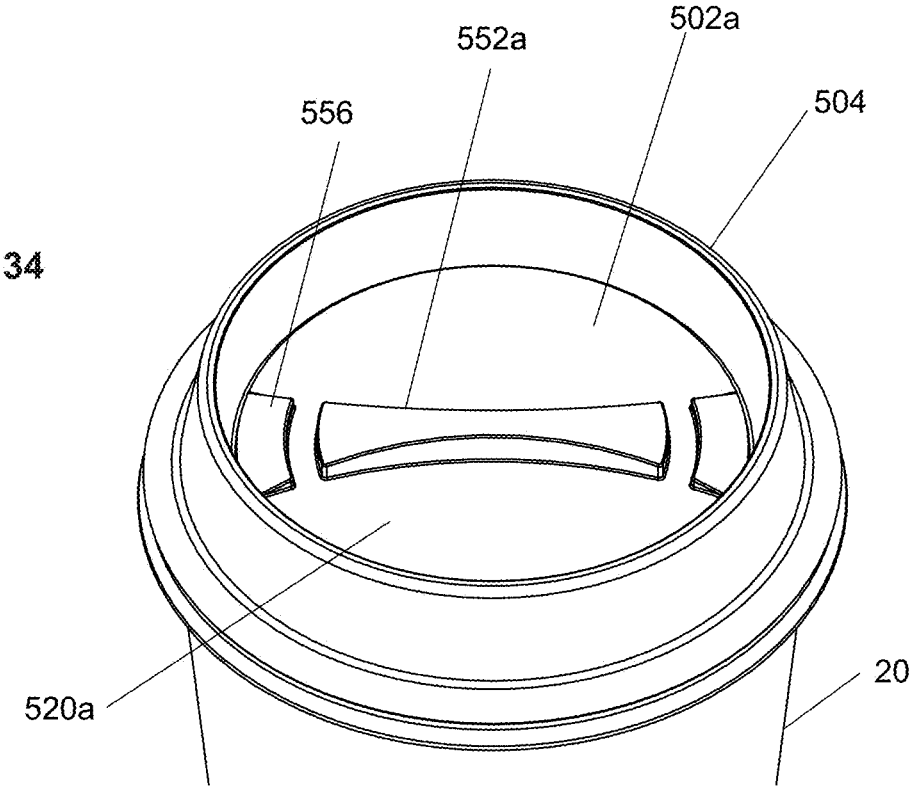
FIG. 34. is a perspective view of a lid for beverage cup in accordance with another embodiment of the present invention.

FIG. 34 shows another embodiment of the upper lid 502*a* wherein the structure of the upper lid is the same as in embodiments 502 except that a unitary disk member 520*a* spans the entire top surface of the upper lid and the grip member 552*a* is elongate and spans a substantial portion of said top surface. Further included are indicators 556 that may be used to indicate whether the cup contains hot or cold beverages, or other useful indications.

Figure 35:
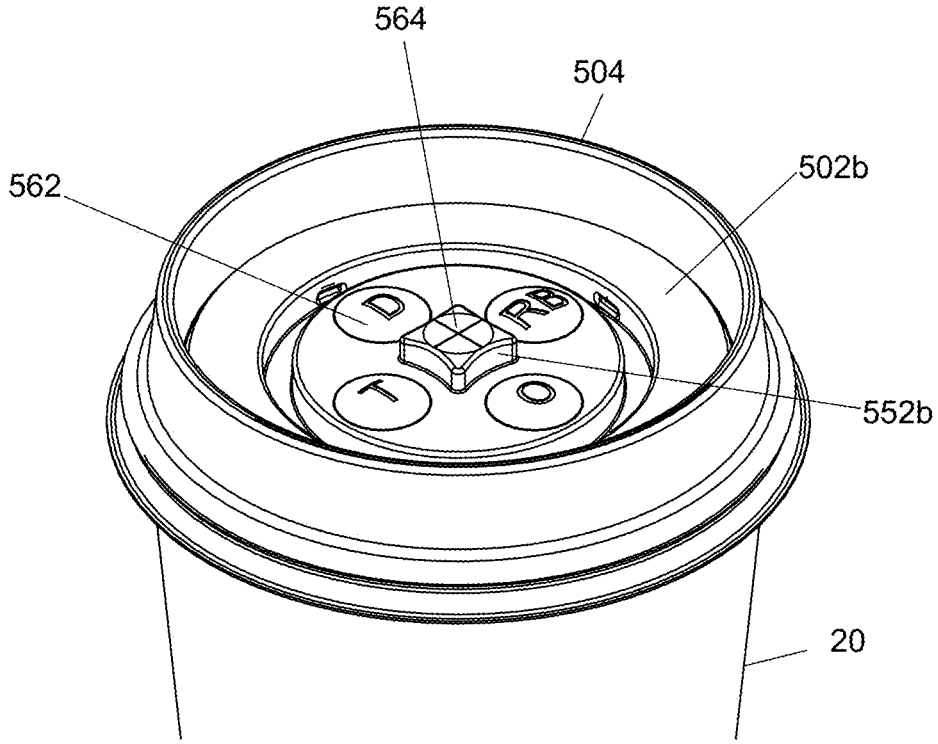
FIG. 35. is a perspective view of a lid for beverage cup in accordance with another embodiment of the present invention.
Figure 36:
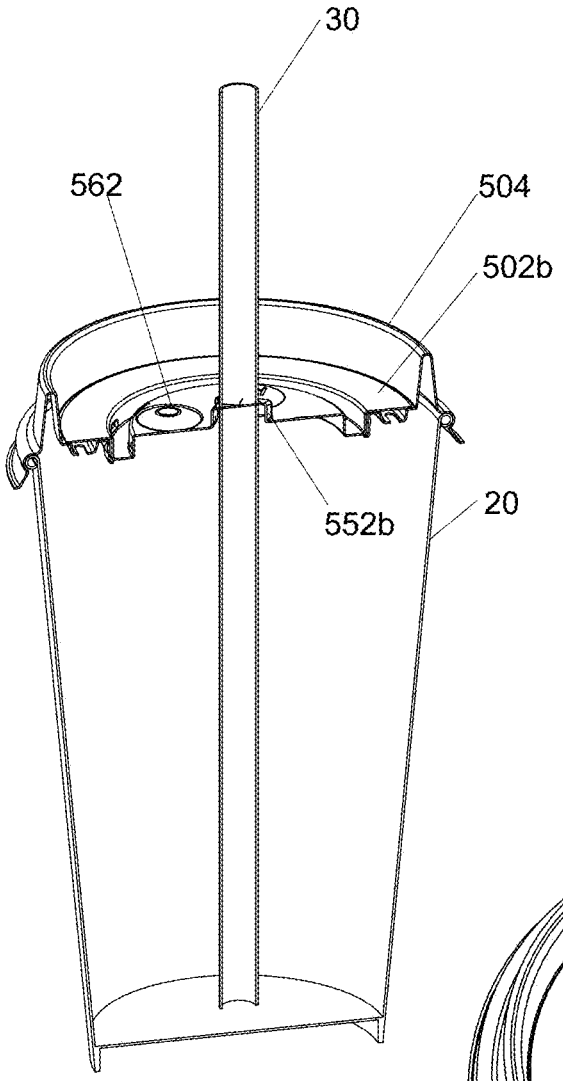
FIG. 36. is a sectional view of the embodiment shown in FIG. 37.

FIGS. 35 and 36 show another embodiment of the upper lid 502*b* wherein the structure of the upper lid is the same as in embodiments 502 except that a central disc portion 520 includes a plurality of depressible bubble indicators 562 that may be used to indicate the type of beverage contained within the cup or other useful information, and the grip member 552*b* is provided with a straw insertion hole 564 for straw 30.

Figure 37:
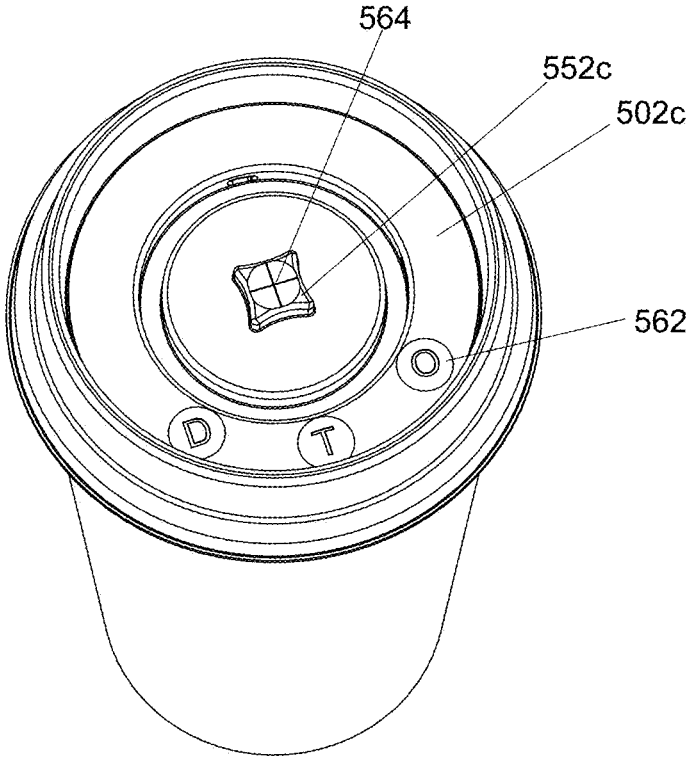
FIG. 37. is a perspective view of a lid for beverage cup in accordance with another embodiment of the present invention.
Figure 38:
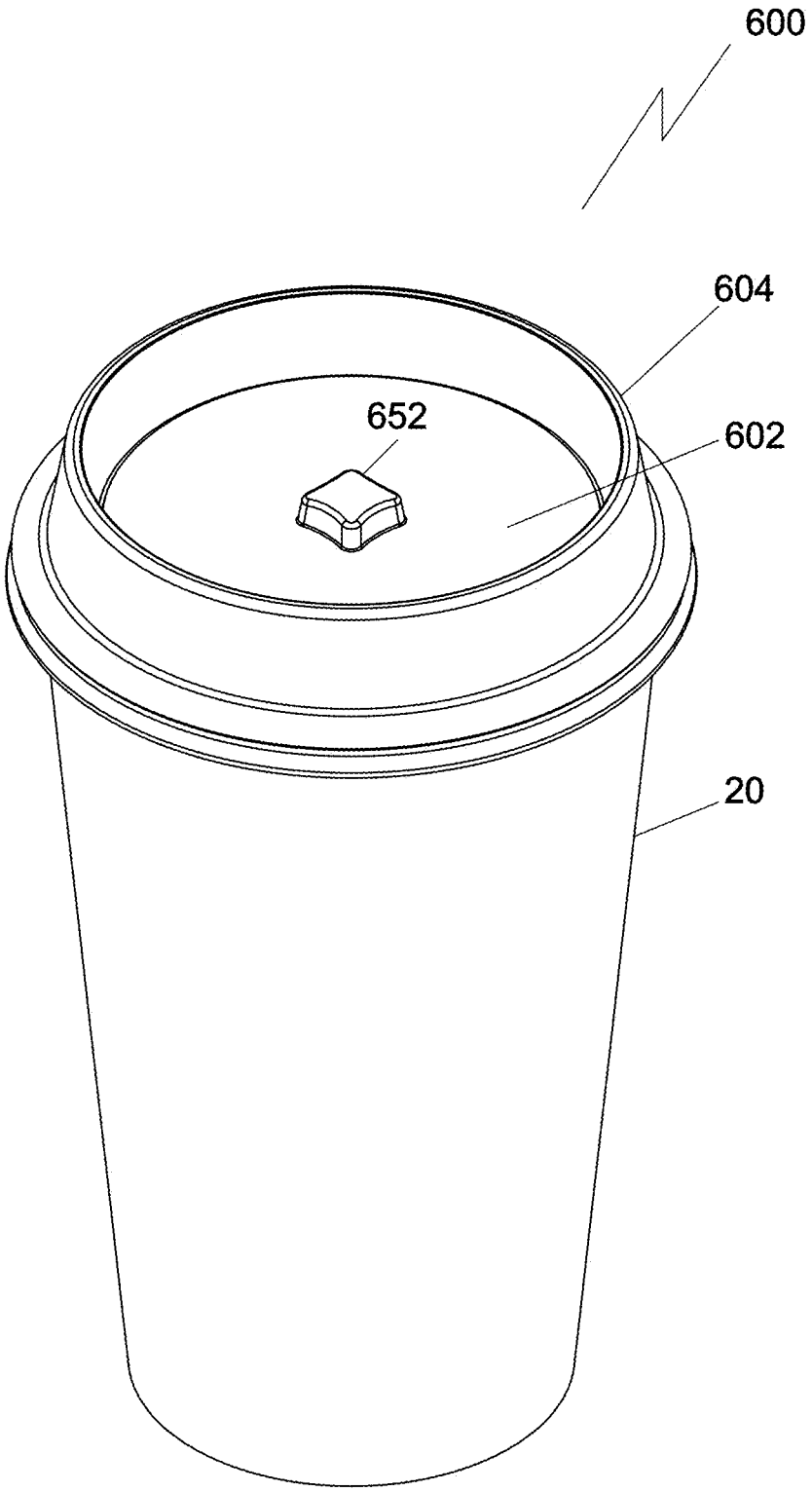
FIG. 38. is a perspective view of a lid for beverage cup in accordance with another embodiment of the present invention.
Figure 39:
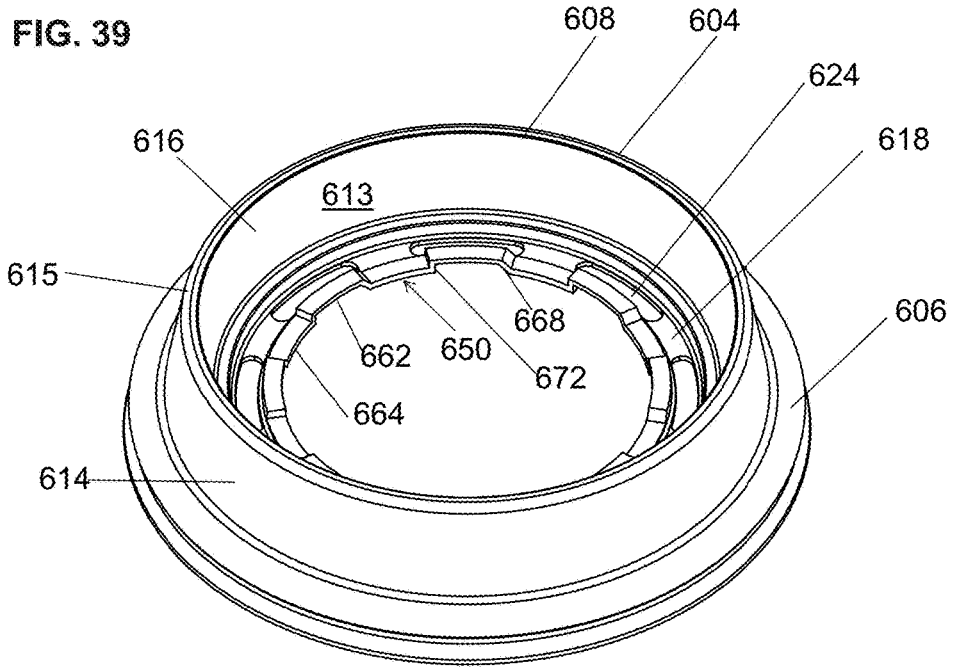
FIG. 39. is a perspective view of a lower lid of the embodiment shown in FIG. 40.
Figure 40:
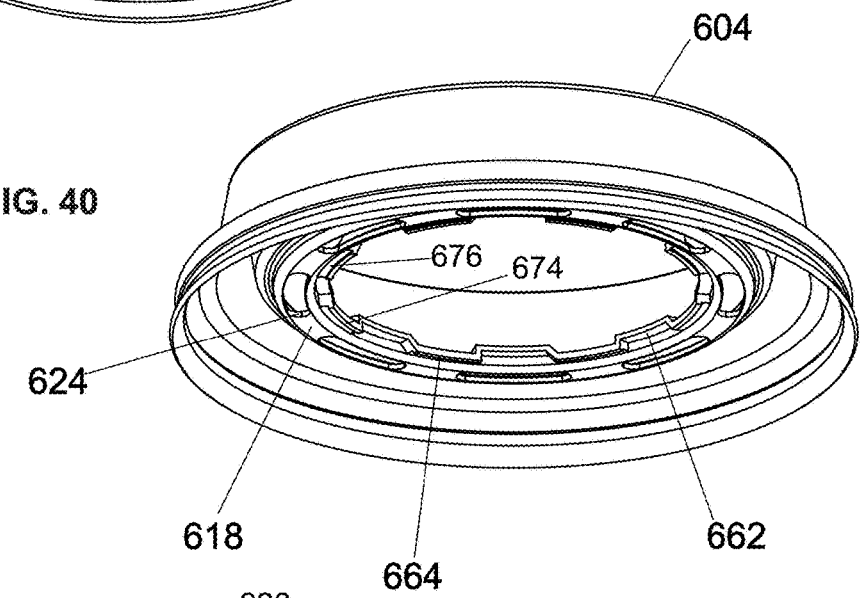
FIG. 40. is a perspective view from the bottom of a lower lid of the embodiment shown in FIG. 40.
Figure 41:
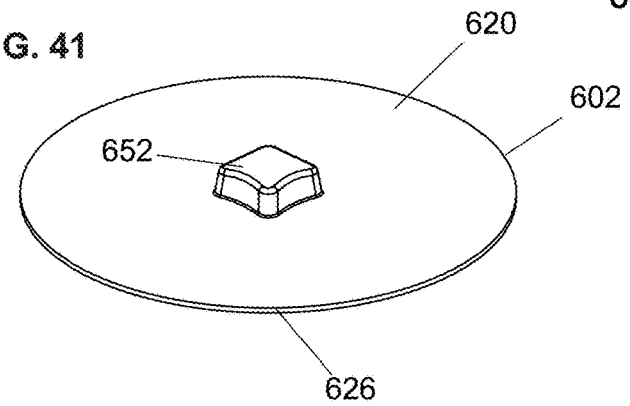
FIG. 41. is a perspective view of an upper lid of the embodiment shown in FIG. 40.

FIG. 37 shows another embodiment of the upper lid 502*c* wherein the structure of the upper lid is the same as in embodiments 502 except that planar annular member 544 includes a plurality of depressible bubble indicators 562 that may be used to indicate the type of beverage contained within the cup or other useful information, and the grip member 552*c* is provided with a straw insertion hole 564.

Referring to FIGS. 38-50 there is shown a lid 600 in accordance with another embodiment of the present invention for being operably connected to a conventional beverage container such as cup 20. Lid 600 comprises lower lid 604 and upper lid 602, which is positioned and nested onto lower lid 604. The lids 604 and 602 are cooperatively dimensioned such that the upper lid 602 is positioned within an inside periphery 613 of the lower lid 604 in an assembled configuration.

The lower lid 604 comprises a lower perimeter skirt 606, which extends around the upper rim 22 of the coffee cup 20. The skirt 606 includes a snap-fit locking mechanism comprised of an annular internal round channel and an annular inwardly projecting edge portion on the lower portion of the rounded channel that is adapted to underlie and directly engage the bottom portion of the rim 22 of the container to retain the lid thereon and provide a secure attachment of the lower lid to the cup 20. The configuration of the skirt 606 and its engagement with the bead 22 of the cup 20 is well known in the art.

Spaced a short distance radially inwardly from the perimeter skirt 606, is a raised perimeter lip portion 608, comprising an outer perimeter wall 614 having an upward and radially inward slant, a narrow top horizontal perimeter wall 615 extending radially inwardly from the outer wall 614, and then a downwardly extending, inwardly facing inner perimeter wall 616 that defines the inward facing surface 613. The narrow top horizontal perimeter wall 615 may be rounded in cross-section.

Radially inward from the inner perimeter wall 616 is defined an annular portion such as trough 618 having a plurality of opening holes 624 positioned around the periphery through which the liquid contents of the cup 20 may flow. The opening holes can consist of different shapes such as square, rectangular and the like.

Radially inward from the trough 618 is an inside perimeter portion 650 in which are defined a series of horizontally oriented alternating high and low portions 662 and 664 respectively. A sloped transition ramp 668 leads from a high portion 662 to the adjacent low portion 664 on one side, and an abrupt stop such as vertical wall 672 joins with the adjacent low portion 664 on the other side. In the illustrated embodiment of the lower lid 604, the transition from a high portion 662 to the adjacent low portion 664 in a clockwise direction is provided by the ramp 668, whereas the transition from the high portion 662 to the adjacent low portion 664 in a counterclockwise direction is provided by the abrupt vertical wall 672. Each low portion 664 has an overhanging edge 674 on the radially inward side of the low portion to define a partial circumferential channel 676 by each low portion 664.

The upper lid 602 includes planar disk member 620 that is sized such that its peripheral edge 626 fits closely within the inside surface 613 of the inner perimeter wall 616 of the lip portion 608 of the lower lid 604. Located centrally on the upper surface of the disk member 620 is a grip member 652 by which a user may rotate the upper lid 602 when operably mounted on the lower lid 604. On the bottom surface of the disk member 620 are provided hooked tabs 680 arranged in a circular configuration and spaced radially inward from the peripheral edge 626. Each hooked tab 680 has an outwardly facing hook portion 682 and a tapered lower surface 684. Guides 686 are also provided on the bottom surface of the disk member 620 and are likewise arranged in a circular configuration at positions that are slightly radially outward from the hooked tabs 680. The number of guides 686 corresponds to the number of hooked tabs 680, and each guide 686 is slightly laterally offset from its corresponding hooked tabs 680. Each guide 686 has a ramp surface 688 that faces in the direction of the corresponding hooked tab 680.

The hooked tabs 680 are positioned on the bottom surface of the disk member 620 such that they are just radially inward from the inside perimeter portion 650 of the lower lid 604 when the upper lid 602 is operably mounted on the lower lid 604. The hooked tabs 680 are arranged such that each hooked tab corresponds to a pair of high portions 662 and low portion 664 on the lower lid 604. The outwardly facing hook portion 682 of each hooked tab 680 outwardly overhangs the portions and the distance between the base of each hooked tab and the overhang of the hook portion corresponds to the height of the high portion 662. Accordingly, as the upper lid 602 is rotated, the upper surface of the hook portions 682 of the hooked tabs 680 ride upon the low portions 664 and the high portion 662. Each guide 668 is located to correspond and ride within a channel 676 of a corresponding low portion 662.

Figure 48:
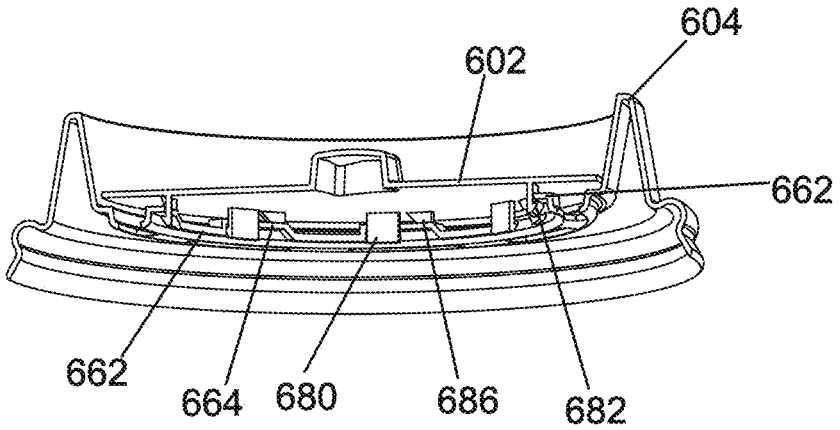
FIG. 48. a sectional view of the embodiment shown in FIG. 40 in an open configuration.
Figure 49:
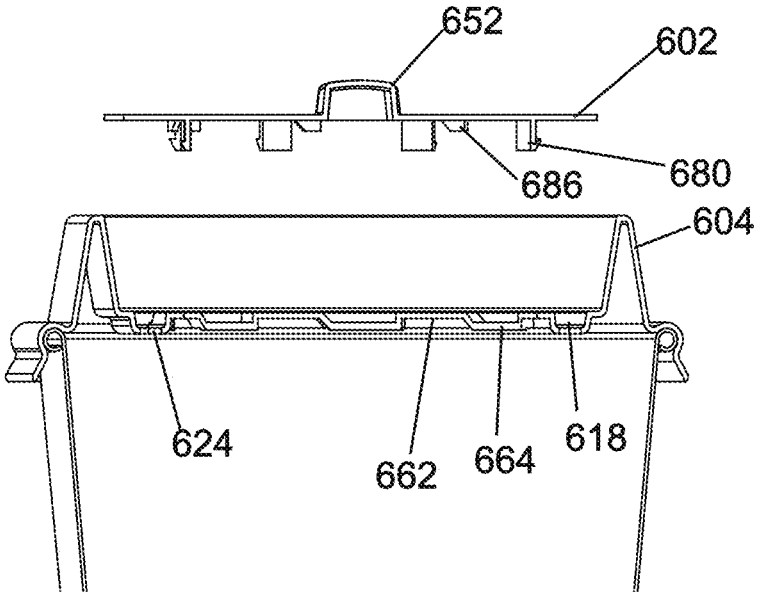
FIG. 49. is a sectional view of the embodiment shown in FIG. 40 with the upper lid shown exploded from the lower lid.
Figure 50:
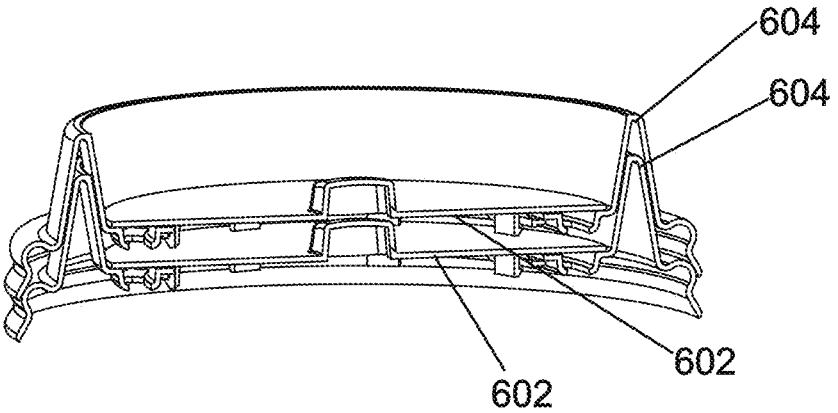
FIG. 50. is a cross section view of stacked lids of the embodiment shown in FIG. 40.

As can be seen from the figures, the upper lid 602 is configured to be received within the lower lid 604 such that the inside perimeter portion 620 of the lower lid 604 is in close proximity to the hooked tabs 680, and the guide 686 are received within the channel 676 of the low portion 662. In such assembled configuration, the peripheral edge 626 of the upper lid 602 is in close proximity or abuts the inside surface 613 of the lip portion 608 of the lower lid 604, and the outer portion of the disk member 620 covers the trough 618 and its holes 624. Rotation of the upper lid 602 in one direction (counterclockwise in the illustrated embodiment) causes the upper lid 602 to rise with respect to the lower lid 604 as the ramp surfaces 688 of each guide 686 rides upon the top surface of a transition ramp 668 from a low portion 664 to the adjacent high portion 662, and as the hooked portions 682 of each hooked tab 680 rides on the bottom surface from a low portion 664 to the adjacent high portion 662. This counterclockwise rotation of the upper lid 602 produces a gap between the outer portion of the disk member 620 and inside surface 613 of the lip portion 608 (as best shown in FIGS. 44 and 48), and provides clearance through which the liquid contents of the cup may flow outward via the openings 624 in the trough 618 thereby enabling the user to drink the contents of the cup. These structures also function as a stop mechanism that retains the upper lid connected to the lower lid.

Figure 45:
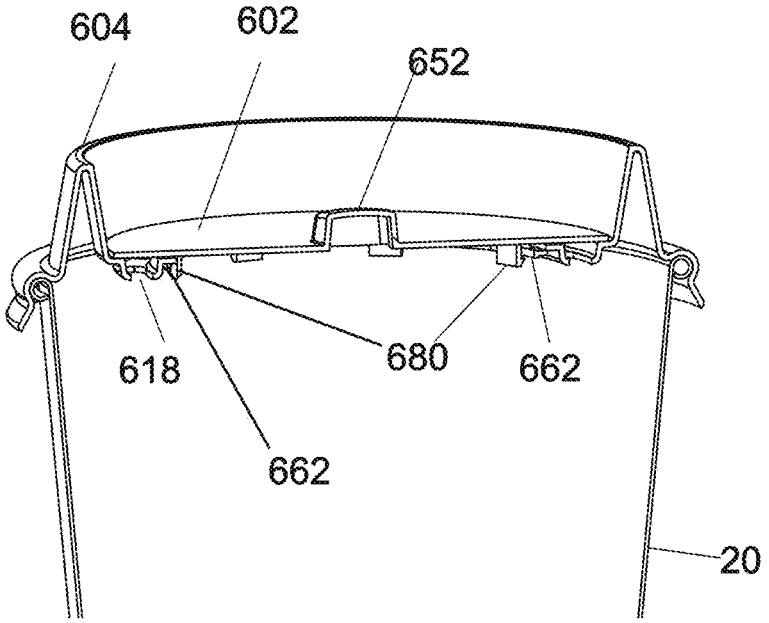
FIG. 45. a sectional view of the embodiment shown in FIG. 40 in a closed configuration.
Figure 46:
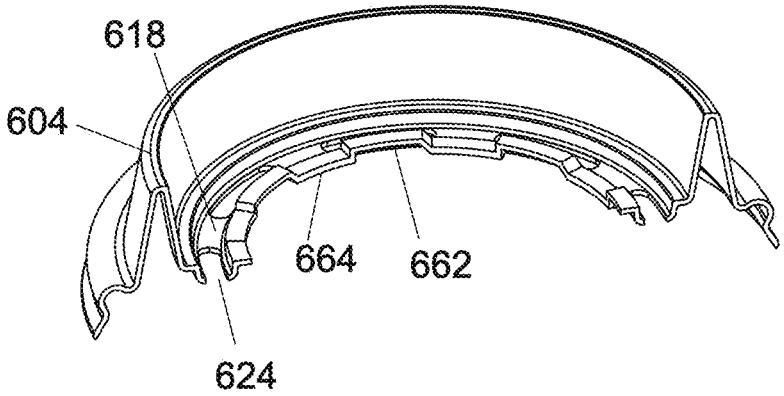
FIG. 46. a sectional view of the lower lid of the embodiment shown in FIG. 40.
Figure 47:
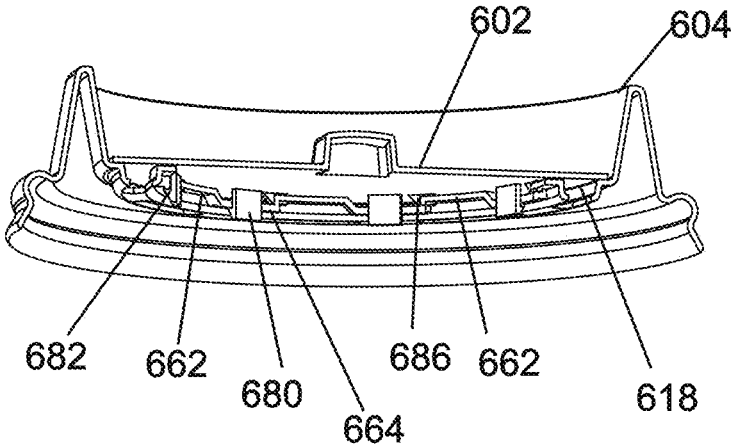
FIG. 47. a sectional view of the embodiment shown in FIG. 40 in a closed configuration.

Rotation of the upper lid 602 in the opposite direction (clockwise in the illustrated embodiment) causes the upper lid 602 to lower with respect to the lower lid 604 as the hook portions 682 of each hooked tab 680 rides upon the lower surface of a transition ramp 668 from a high portion 662 to the adjacent low portion 664, and as each guide 686 rides on the top surface from a high portion 662 to the adjacent low portion 664. This clockwise rotation of the upper lid 602 eliminates the gap between the outer portion of the disk member 620 and the inside surface 613 of the lip portion 608 (as best shown in FIGS. 45 and 47) to effectively cover the trough 618 and the opening holes 624. In this closed configuration, the liquid contents of the cup is prevented from inadvertently flowing out.

The various embodiments of the invention may be made of plastic or of any other resiliently flexible material such as flexible high density polypropylene, polystyrene, polyethylene, polyurethane, other lightweight materials and other suitable material. Further, the various components of the lids of the present invention may be made of different materials and by any suitable manufacturing processes. For example, the lids for the individual components may be formed by a variety of manufacturing processes known in the art such as injection molding or thermoforming operation, such as vacuum forming and/or pressure forming, and the like. The lids of the present invention may be of varying size or shape as desired in order to fit a particular size or shape of beverage container or cup by a fast food industry, beverage company and the like.

In some embodiments, a plurality of promotional or advertising messages may be provided on any visible generally flat surface of either the upper lid or lower lid.

Some advantages of the present invention include, without limitation, that it provides a secure lid with an easy to use drinking mechanism that provides a large drinking area and resists unintentional splashing of the beverage from the container. The lids are relatively easy to manufacture and to assemble. The lids are highly stackable and minimize the space they occupy in the stacked configuration, making them easy to store on counters, storage spaces, or warehouses. In some embodiments of the present invention, the interlocking mechanism provides an easy to use locking and unlocking feature of the lids that further guards against unintentional splashing or spilling of the beverage from the container. Additionally, the upper and lower lids avoid getting stuck together during use as a result of liquid flowing in between the two lids portions by virtue of good drainage of residual liquid via the perimeter openings. As well, the upper lid provides a generally flat surface and can be used to support another cup placed on top of the lid as is often done by users needing to carry more than two beverage cups. Other advantages of the invention will be readily understood from the foregoing description taken in connection with the accompanying drawings.

While the above description and illustrations constitute preferred or alternate embodiments of the present invention, it will be appreciated that numerous variations may be made without departing from the scope of the invention. It is intended that the invention be construed as including all such modifications and alterations.

What is claimed is:

1. A lid for a beverage container comprising:

a lower lid having a perimeter skirt adapted to secure the lower lid to an opening of the beverage container, a lip portion radially inward from the skirt and extending upward from the skirt and defining an inside surface, an annular portion radially inward from the lip portion and defining a plurality of openings through which liquid from the container may flow;

an upper horizontal lid retained on the lower lid and having a perimeter edge that is sized to closely conform with the inside surface, the upper lid covering the annular portion in a closed position;

an annular first vertical wall on the lower lid radially inward from the annular portion and an annular second vertical wall extending downward from a bottom surface of the upper lid and configured to be in close proximity to the first vertical wall; and a cam interface between the first vertical wall and the second vertical wall, the cam interface comprising one or more channels defined in one of the first vertical wall and the second vertical wall and one or more corresponding projections extending from the other of the first vertical wall and the second vertical wall, the one or more channels being angled to extend from a bottom of the respective vertical wall towards a top thereof, the one or more projections being configured to travel within the one or more channels such that rotation of the upper lid in one direction relative to the lower lid causes the one or more projections to travel upward in the one or more channels, causing the upper lid to rise relative to the lower lid to uncover the openings and allow liquid flow out of the lid, and rotation of the upper lid in the opposite direction relative to the lower lid causes the one or more projections to travel downward in the one or more channels, causing the upper lid to move into contact with the lower lid to cover the openings and restrict liquid flow out of the lid.

2. The lid as claimed in claim 1, wherein the one or more channels are defined in the first vertical wall and the one or more projections extend from the second vertical wall.

3. The lid as claimed in claim 1 further comprising a horizontal central platform on the upper lid having a grip member extending from a top surface of the platform to facilitate rotation of the upper lid relative to the lower lid and thereby open and close the lid.

* * * * *